US009607543B2

(12) United States Patent
Hao et al.

(10) Patent No.: US 9,607,543 B2
(45) Date of Patent: Mar. 28, 2017

(54) DRIVING CIRCUIT

(71) Applicant: Wuhan China Star Optoelectronics Technology Co., Ltd., Wuhan (CN)

(72) Inventors: Sikun Hao, Wuhan (CN); Xin Zhang, Wuhan (CN); Ronglei Dai, Wuhan (CN)

(73) Assignee: Wuhan China Star Optoelectronics Technology Co., Ltd., Wuhan (CN)

( * ) Notice: Subject to any disclaimer, the term of this patent is extended or adjusted under 35 U.S.C. 154(b) by 0 days.

(21) Appl. No.: 14/779,013

(22) PCT Filed: Aug. 7, 2015

(86) PCT No.: PCT/CN2015/086375
§ 371 (c)(1),
(2) Date: Sep. 22, 2015

(65) Prior Publication Data

US 2017/0032734 A1 Feb. 2, 2017

(30) Foreign Application Priority Data

Jul. 29, 2015 (CN) ..... 2015 1 0456411

(51) Int. Cl.
*G09G 3/20* (2006.01)
*G09G 3/3266* (2016.01)
*G09G 3/36* (2006.01)

(52) U.S. Cl.
CPC ..... *G09G 3/2096* (2013.01); *G09G 3/3266* (2013.01); *G09G 3/3677* (2013.01); *G09G 2300/0426* (2013.01); *G09G 2300/0814* (2013.01); *G09G 2310/0208* (2013.01); *G09G 2310/0289* (2013.01)

(58) Field of Classification Search
None
See application file for complete search history.

*Primary Examiner* — Kenneth B Lee, Jr.

(57) ABSTRACT

A driving circuit is provided, a driving unit of the driving circuit includes: a control unit utilized to control an output of a stage transmission signal; a stage transmission signal latch unit utilized to receive the stage transmission signal for generating a latch signal; a first and second scanning signal generation units; a first inverted output unit utilized to invert the first scanning signal; a second inverted output unit utilized to invert the second scanning signal. A configuration of a GOA circuit can be simplified.

19 Claims, 10 Drawing Sheets

DRIVING CIRCUIT

RELATED APPLICATIONS

This application is a National Phase of PCT Patent Application No. PCT/CN2015/086375 having International filing date of Aug. 7, 2015, which claims the benefit of priority of Chinese Patent Application No. 201510456411.6 filed on Jul. 29, 2015. The contents of the above applications are all incorporated by reference as if fully set forth herein in their entirety.

TECHNICAL FIELD OF THE INVENTION

The present invention relates to a driving technology, and in particular to a driving circuit.

BACKGROUND OF THE INVENTION

A conventional GOA (Gate driver On Array) technical solution is generally to form a scanning driving circuit in a thin film transistor (TFT) array substrate by the processes of the prior art TFT array substrate, so order to achieve a line-by-line scan for a pixel array on the TFT array substrate.

However, a configuration of the conventional GOA circuit is too complex, and it is difficult to adapt to the requirement of a display panel with an ultra-narrow bezel.

Therefore, there is a significant need to provide a new technical solution for solving the above-mentioned technical problem.

SUMMARY OF THE INVENTION

An objective of the present invention is to provide a driving circuit, which can simplify the configuration of a GOA circuit to meet the requirement of the display panel with an ultra-narrow bezel.

In order to achieve the foregoing objective, the technical solution of this invention is implemented as follows.

A driving circuit includes: at least two driving units arranged in an array and coupled with each other, a first driving unit of the at least two driving units utilized to receive at least one second sub signal of a second driving signal set which is generated by a second driving unit, and to generate a first driving signal set, wherein the second driving unit is a driving unit except the first driving unit in the at least two the driving units; wherein the driving unit comprises: a control unit utilized to control an output of a stage transmission signal according to forward and reverse scanning signals; a stage transmission signal latch unit utilized to receive the stage transmission signal and to latch the stage transmission signal for generating a latch signal; a first scanning signal generation unit utilized to generate a first scanning signal; a second scanning signal generation unit utilized to generate a second scanning signal; a first inverted output unit utilized to invert the first scanning signal and generate an inverted first scanning signal; and a second inverted output unit utilized to invert the second scanning signal generate an inverted second scanning signal; the control unit comprising a first stage transmission signal input terminal, a second stage transmission signal input terminal, a first switch control signal input terminal, a second switch control signal input terminal, and a first stage transmission signal output terminal; the control unit further comprising: a first TFT comprising a first gate, a first source, and a first drain, the first gate coupled to the first switch control signal input terminal, the first source coupled to the first stage transmission signal input terminal, the first drain coupled to the first stage transmission signal output terminal, the first TFT utilized to control an output of a first stage transmission signal of the first stage transmission signal input terminal according to a first switch control signal provided by the first switch control signal input terminal; a second TFT comprising a second gate, a second source, and a second drain, the second gate coupled to the first switch control signal input terminal, the second source coupled to the second stage transmission signal input terminal, the second drain coupled to the first stage transmission signal output terminal, the second TFT utilized to control an output of a second stage transmission signal of the second stage transmission signal input terminal according to the first switch control signal; a third TFT comprising a third gate, a third source, and a third drain, the third gate coupled to the second switch control signal input terminal, the third source coupled to the first stage transmission signal input terminal, the third drain coupled to the first stage transmission signal output terminal, the third TFT utilized to control the output of the first stage transmission signal according to a second switch control signal provided by the second switch control signal input terminal; and a fourth TFT comprising a fourth gate, a fourth source, and a fourth drain, the fourth gate coupled to the second switch control signal input terminal, the fourth source coupled to the second stage transmission signal input terminal, the fourth drain coupled to the first stage transmission signal output terminal, the fourth TFT utilized to control the output of the second stage transmission signal according to the second switch control signal; the stage transmission signal latch unit comprising a first clock signal input terminal, a third stage transmission signal input terminal, and a latch signal output terminal; the stage transmission signal latch unit further comprising: a first inverter comprising a first inverted input terminal and a first inverted output terminal, the first inverted input terminal coupled to the first clock signal input terminal, the first inverted input terminal utilized to receive a first clock signal; a second inverter comprising a second inverted input terminal and a second inverted output terminal, the second inverted input terminal coupled to the first inverted output terminal, the second inverter further coupled to the third stage transmission signal input terminal and the latch signal output terminal; a third inverter comprising a third inverted input terminal and a third inverted output terminal, the third inverted input terminal coupled to the first clock signal input terminal, the third inverter further coupled to the third stage transmission signal input terminal and the latch signal output terminal, the third inverted input terminal utilized to receive the first clock signal; and a fourth inverter comprising a fourth inverted input terminal and a fourth inverted output terminal, the fourth inverted input terminal coupled to the third inverted output terminal and the second inverted output terminal, the fourth inverted output terminal coupled to the latch signal output terminal.

In the above-mentioned driving circuit, a second current channel of the second TFT is turn off when a first current channel of the first TFT is turned on, and the second current channel is turned on when the first current channel is turn off, the first current channel being a current channel between the first source and the first drain, the second current channel being a current channel between the second source and the second drain; a fourth current channel of the fourth TFT is turn off when a third current channel of the third TFT is turned on, and the fourth current channel is turned on when the third current channel is turn off, the third current channel being a current channel between the third source and the third drain, the fourth current channel being a current channel between the fourth source and the fourth drain.

In the above-mentioned driving circuit, a combination of the first inverter, the second inverter, the third inverter, and the fourth inverter are utilized to shift and latch the stage transmission signal.

In the above-mentioned driving circuit, the second inverter comprises a fifth TFT, a sixth TFT, a seventh TFT and an eighth TFT; the third inverter comprises a ninth TFT, a tenth TFT, an eleventh TFT and a twelfth TFT; the fifth TFT comprises a fifth gate, a fifth source, and a fifth drain, the fifth gate coupled to the first inverted output terminal, the fifth source utilized to receive a first high-voltage signal, the fifth TFT utilized to turn on a fifth current channel between the fifth source and the fifth drain when the inverted first clock signal received by the fifth gate is a low level signal, and utilized to turn off the fifth current channel when the inverted first clock signal received by the fifth gate is a high level signal; the sixth TFT comprises a sixth gate, a sixth source, and a sixth drain, the sixth gate utilized to receive the third stage transmission signal, the sixth source coupled to the fifth drain, the sixth drain coupled to the fourth inverted input terminal, the sixth TFT utilized to turn on a sixth current channel between the sixth source and the sixth drain when the third stage transmission signal received by the sixth gate is a low level signal, and utilized to turn off the sixth current channel when the received third stage transmission signal is a high level signal; the seventh TFT comprises a seventh gate, a seventh source, and a seventh drain, the seventh gate utilized to receive a fourth stage transmission signal, the seventh source utilized to receive a first low-voltage signal, the seventh TFT utilized to turn on a seventh current channel between the seventh source and the seventh drain when the fourth stage transmission signal received by the seventh gate is a high level signal, and utilized to turn off the seventh current channel when the received fourth stage transmission signal is a low level signal; the eighth TFT comprises an eighth gate, an eighth source, and an eighth drain, the eighth gate coupled to the first inverted output terminal, the eighth source coupled to the seventh drain, the eighth drain coupled to the fourth inverted input terminal, the eighth TFT utilized to turn on an eighth current channel between the eighth source and the eighth drain when the inverted first clock signal received the by the eighth gate is a high level signal, and utilized to turn off the eighth current channel when the inverted first clock signal received by the eighth gate is a low level signal; the ninth TFT comprises a ninth gate, a ninth source, and a ninth drain, the ninth gate utilized to receive the first clock signal, the ninth drain coupled to the fourth inverted input terminal, the ninth TFT utilized to turn on a ninth current channel between the ninth source and the ninth drain when the first clock signal received by the ninth gate is a high level signal, and utilized to turn off the ninth current channel when the received first clock signal is a low level signal; the tenth TFT comprises a tenth gate, a tenth source, and a tenth drain, the tenth gate coupled to the sixth gate, the tenth gate utilized to receive the third stage transmission signal, the tenth drain coupled to the ninth source, the tenth source utilized to receive a second low-voltage signal, the tenth TFT utilized to turn on a tenth current channel between the tenth source and the tenth drain when the third stage transmission signal received by the tenth gate is a high level signal, and utilized to turn off the tenth current channel when the received third stage transmission signal is a low level signal; the eleventh TFT comprises an eleventh gate, an eleventh source, and an eleventh drain, the eleventh gate utilized to receive the fourth stage transmission signal, the eleventh drain further coupled to the fourth inverted input terminal, the eleventh TFT utilized to turn on an eleventh current channel between the eleventh source and the eleventh drain when the fourth stage transmission signal received by the eleventh gate is a low level signal, and utilized to turn off the eleventh current channel when the received fourth stage transmission signal is a high level signal; and the twelfth TFT comprises a twelfth gate, a twelfth source, and a twelfth drain, the twelfth gate utilized to receive the first clock signal, the twelfth source utilized to receive a second high-voltage signal, the twelfth drain coupled to the eleventh source, the twelfth TFT utilized to turn on a twelfth current channel between the twelfth source and the twelfth drain when the first clock signal received by the twelfth gate is a low level signal, and utilized to turn off the twelfth current channel when the received first clock signal is a high level signal; wherein the fourth inverted output terminal is further coupled to the seventh gate and the eleventh gate.

In the above-mentioned driving circuit, the driving circuit further comprises: a resetting unit comprising a twenty-fifth TFT, the twenty-fifth TFT comprises a twenty-fifth gate, a twenty-fifth source and a twenty-fifth drain; the twenty-fifth source utilized to receive a fifth high-voltage signal, the twenty-fifth drain coupled to the stage transmission signal latch unit; the twenty-fifth gate utilized to receive a circuit resetting signal, and utilized to turn on or turn off a twenty-fifth current channel between the twenty-fifth source and the twenty-fifth drain according to the circuit resetting signal.

A driving circuit includes: at least two driving units arranged in an array and coupled with each other, a first driving unit of the at least two driving units utilized to receive at least one second sub signal of a second driving signal set which is generated by a second driving unit, and to generate a first driving signal set, wherein the second driving unit is a driving unit except the first driving unit in the at least two the driving units; wherein the driving unit comprises: a control unit utilized to control an output of a stage transmission signal according to forward and reverse scanning signals; a stage transmission signal latch unit utilized to receive the stage transmission signal and to latch the stage transmission signal for generating a latch signal; a first scanning signal generation unit utilized to generate a first scanning signal; a second scanning signal generation unit utilized to generate a second scanning signal; a first inverted output unit utilized to invert the first scanning signal and generate an inverted first scanning signal; and a second inverted output unit utilized to invert the second scanning signal generate an inverted second scanning signal.

In the above-mentioned driving circuit, the control unit comprising a first stage transmission signal input terminal, a second stage transmission signal input terminal, a first switch control signal input terminal, a second switch control signal input terminal, and a first stage transmission signal output terminal; the control unit further comprising: a first TFT comprising a first gate, a first source, and a first drain, the first gate coupled to the first switch control signal input terminal, the first source coupled to the first stage transmission signal input terminal, the first drain coupled to the first stage transmission signal output terminal, the first TFT utilized to control an output of a first stage transmission signal of the first stage transmission signal input terminal according to a first switch control signal provided by the first switch control signal input terminal; a second TFT comprising a second gate, a second source, and a second drain, the second gate coupled to the first switch control signal input terminal, the second source coupled to the second stage transmission signal input terminal, the second drain coupled to the first stage transmission signal output terminal, the second TFT utilized to control an output of a second stage transmission signal of the second stage transmission signal input terminal according to the first switch control signal; a third TFT comprising a third gate, a third source, and a third drain, the third gate coupled to the second switch control signal input terminal, the third source coupled to the first stage transmission signal input terminal, the third drain coupled to the first stage transmission signal output terminal, the third TFT utilized to control the output of the first stage transmission signal according to a second switch control signal provided by the second switch control signal input terminal; and a fourth TFT comprising a fourth gate, a fourth source, and a fourth drain, the fourth gate coupled to the second switch control signal input terminal, the fourth source coupled to the second stage transmission signal input terminal, the fourth drain coupled to the first stage transmission signal output terminal, the fourth TFT utilized to control the output of the second stage transmission signal according to the second switch control signal.

In the above-mentioned driving circuit, a second current channel of the second TFT is turn off when a first current channel of the first TFT is turned on, and the second current channel is turned on when the first current channel is turn off, the first current channel being a current channel between the first source and the first drain, the second current channel being a current channel between the second source and the second drain; a fourth current channel of the fourth TFT is turn off when a third current channel of the third TFT is turned on, and the fourth current channel is turned on when the third current channel is turn off, the third current channel being a current channel between the third source and the third drain, the fourth current channel being a current channel between the fourth source and the fourth drain.

In the above-mentioned driving circuit, the stage transmission signal latch unit comprising a first clock signal input terminal, a third stage transmission signal input terminal, and a latch signal output terminal; the stage transmission signal latch unit further comprising: a first inverter comprising a first inverted input terminal and a first inverted output terminal, the first inverted input terminal coupled to the first clock signal input terminal, the first inverted input terminal utilized to receive a first clock signal; a second inverter comprising a second inverted input terminal and a second inverted output terminal, the second inverted input terminal coupled to the first inverted output terminal, the second inverter further coupled to the third stage transmission signal input terminal and the latch signal output terminal; a third inverter comprising a third inverted input terminal and a third inverted output terminal, the third inverted input terminal coupled to the first clock signal input terminal, the third inverter further coupled to the third stage transmission signal input terminal and the latch signal output terminal, the third inverted input terminal utilized to receive the first clock signal; and a fourth inverter comprising a fourth inverted input terminal and a fourth inverted output terminal, the fourth inverted input terminal coupled to the third inverted output terminal and the second inverted output terminal, the fourth inverted output terminal coupled to the latch signal output terminal.

In the above-mentioned driving circuit, a combination of the first inverter, the second inverter, the third inverter, and the fourth inverter are utilized to shift and latch the stage transmission signal.

In the above-mentioned driving circuit, the second inverter comprises a fifth TFT, a sixth TFT, a seventh TFT and an eighth TFT; the third inverter comprises a ninth TFT, a tenth TFT, an eleventh TFT and a twelfth TFT; the fifth TFT comprises a fifth gate, a fifth source, and a fifth drain, the fifth gate coupled to the first inverted output terminal, the fifth source utilized to receive a first high-voltage signal, the fifth TFT utilized to turn on a fifth current channel between the fifth source and the fifth drain when the inverted first clock signal received by the fifth gate is a low level signal, and utilized to turn off the fifth current channel when the inverted first clock signal received by the fifth gate is a high level signal; the sixth TFT comprises a sixth gate, a sixth source, and a sixth drain, the sixth gate utilized to receive the third stage transmission signal, the sixth source coupled to the fifth drain, the sixth drain coupled to the fourth inverted input terminal, the sixth TFT utilized to turn on a sixth current channel between the sixth source and the sixth drain when the third stage transmission signal received by the sixth gate is a low level signal, and utilized to turn off the sixth current channel when the received third stage transmission signal is a high level signal; the seventh TFT comprises a seventh gate, a seventh source, and a seventh drain, the seventh gate utilized to receive a fourth stage transmission signal, the seventh source utilized to receive a first low-voltage signal, the seventh TFT utilized to turn on a seventh current channel between the seventh source and the seventh drain when the fourth stage transmission signal received by the seventh gate is a high level signal, and utilized to turn off the seventh current channel when the received fourth stage transmission signal is a low level signal; the eighth TFT comprises an eighth gate, an eighth source, and an eighth drain, the eighth gate coupled to the first inverted output terminal, the eighth source coupled to the seventh drain, the eighth drain coupled to the fourth inverted input terminal, the eighth TFT utilized to turn on an eighth current channel between the eighth source and the eighth drain when the inverted first clock signal received the by the eighth gate is a high level signal, and utilized to turn off the eighth current channel when the inverted first clock signal received by the eighth gate is a low level signal; the ninth TFT comprises a ninth gate, a ninth source, and a ninth drain, the ninth gate utilized to receive the first clock signal, the ninth drain coupled to the fourth inverted input terminal, the ninth TFT utilized to turn on a ninth current channel between the ninth source and the ninth drain when the first clock signal received by the ninth gate is a high level signal, and utilized to turn off the ninth current channel when the received first clock signal is a low level signal; the tenth TFT comprises a tenth gate, a tenth source, and a tenth drain, the tenth gate coupled to the sixth gate, the tenth gate utilized to receive the third stage transmission signal, the tenth drain coupled to the ninth source, the tenth source utilized to receive a second low-voltage signal, the tenth TFT utilized to turn on a tenth current channel between the tenth source and the tenth drain when the third stage transmission signal received by the tenth gate is a high level signal, and utilized to turn off the tenth current channel when the received third stage transmission signal is a low level signal; the eleventh TFT comprises an eleventh gate, an eleventh source, and an eleventh drain, the eleventh gate utilized to receive the fourth stage transmission signal, the eleventh drain further coupled to the fourth inverted input terminal, the eleventh TFT utilized to turn on an eleventh current channel between the eleventh source and the eleventh drain when the fourth stage transmission signal received by the eleventh gate is a low level signal, and utilized to turn off the eleventh current channel when the received fourth stage transmission signal is a high level signal; the twelfth TFT comprises a twelfth gate, a twelfth source, and a twelfth drain, the twelfth gate utilized to receive the first clock signal, the twelfth source utilized to receive a second high-voltage signal, the twelfth drain coupled to the eleventh source, the twelfth TFT utilized to turn on a twelfth current channel between the twelfth source and the twelfth drain when the first clock signal received by the twelfth gate is a low level signal, and utilized to turn off the twelfth current channel when the received first clock signal is a high level signal; wherein the fourth inverted output terminal is further coupled to the seventh gate and the eleventh gate.

In the above-mentioned driving circuit, the first scanning signal generation unit comprises a second clock signal input terminal, a first latch signal input terminal, a fourth stage transmission signal input terminal/a fourth clock signal input terminal, and a first scanning signal output terminal, wherein the first latch signal input terminal is coupled to the latch signal output terminal; the first scanning signal generation unit further comprising: a thirteenth TFT comprising a thirteenth gate, a thirteenth source, and a thirteenth drain, the thirteenth gate coupled to the second clock signal input terminal, the thirteenth gate utilized to receive a second clock signal provided by the second clock signal input terminal, the thirteenth source utilized to receive a third high-voltage signal, the thirteenth drain coupled to the first scanning signal output terminal, the thirteenth TFT utilized to turn on a thirteenth current channel between the thirteenth source and the thirteenth drain when the second clock signal received by the thirteenth gate is a low level signal, and utilized to turn off the thirteenth current channel when the second clock signal is a high level signal; a fourteenth TFT comprising a fourteenth gate, a fourteenth source, and a fourteenth drain, the fourteenth gate coupled to the first latch signal input terminal, the fourteenth gate utilized to receive the latch signal provided by the first latch signal input terminal, the fourteenth source utilized to receive the third high-voltage signal, the fourteenth drain coupled to the first scanning signal output terminal, the fourteenth TFT utilized to turn on a fourteenth current channel between the fourteenth source and the fourteenth drain when the latch signal received by the fourteenth gate is a low level signal, and utilized to turn off the fourteenth current channel when the latch signal is a high level signal; a fifteenth TFT comprising a fifteenth gate, a fifteenth source, and a fifteenth drain, the fifteenth gate coupled to the fourth stage transmission signal input terminal or the fourth clock signal input terminal, the fifteenth gate utilized to receive a fourth stage transmission signal provided by the fourth stage transmission signal input terminal or a fourth clock signal provided by the fourth clock signal input terminal, the fifteenth source utilized to receive the third high-voltage signal, the fifteenth drain coupled to the first scanning signal output terminal, the fifteenth TFT utilized to turn on a fifteenth current channel between the fifteenth source and the fifteenth drain when the fourth stage transmission signal or the fourth clock signal received by the fifteenth gate is a low level signal, and utilized to turn off the fifteenth current channel when the fourth stage transmission signal or the fourth clock signal is a low level signal; a sixteenth TFT comprising a sixteenth gate, a sixteenth source, and a sixteenth drain, the sixteenth gate coupled to the second clock signal input terminal, the sixteenth gate utilized to receive the second clock signal provided by the second clock signal input terminal, the sixteenth drain coupled to the first scanning signal output terminal, the sixteenth TFT utilized to turn on a sixteenth current channel between the sixteenth source and the sixteenth drain when the second clock signal received by the sixteenth gate is a high level signal, and utilized to turn off the sixteenth current channel when the second clock signal is a low level signal; a seventeenth TFT comprising a seventeenth gate, a seventeenth source, and a seventeenth drain, the seventeenth gate coupled to the first latch signal input terminal, the seventeenth gate utilized to receive the latch signal provided by the first latch signal input terminal, the seventeenth drain coupled to the sixteenth source, the seventeenth TFT utilized to turn on a seventeenth current channel between the seventeenth source and the seventeenth drain when the latch signal received by the seventeenth gate is a high level signal, and utilized to turn off the seventeenth current channel when the latch signal is a low level signal; and an eighteenth TFT comprising a eighteenth gate, a eighteenth source, and a eighteenth drain, the eighteenth gate coupled to the fourth stage transmission signal input terminal or the fourth clock signal input terminal, the eighteenth gate utilized to receive the fourth stage transmission signal provided by the fourth stage transmission signal input terminal or the fourth clock signal provided by the fourth clock signal input terminal, the eighteenth source utilized to receive the third low-voltage signal, the eighteenth drain coupled to the seventeenth source, the eighteenth TFT utilized to turn on a eighteenth current channel between the eighteenth source and the eighteenth drain when the fourth stage transmission signal or the fourth clock signal received by the eighteenth gate is a high level signal, and utilized to turn off the eighteenth current channel when the fourth stage transmission signal or the fourth clock signal is a low level signal; the second scanning signal generation unit comprises a third clock signal input terminal/a sixth clock signal input terminal, a second latch signal input terminal, a fifth stage transmission signal input terminal/a fifth clock signal input terminal, and a second scanning signal output terminal, wherein the second latch signal input terminal is coupled to the latch signal output terminal, the fifth stage transmission signal input terminal coupled to the fourth stage transmission signal input terminal, the fifth clock signal input terminal coupled to the fourth clock signal input terminal; the second scanning signal generation unit further comprising: a nineteenth TFT comprising a nineteenth gate, a nineteenth source, and a nineteenth drain, the nineteenth gate coupled to the fifth stage transmission signal input terminal or the fifth clock signal input terminal, the nineteenth gate utilized to receive a fourth stage transmission signal provided by the fifth stage transmission signal input terminal or a fifth clock signal provided by the fifth clock signal input terminal, the nineteenth source utilized to receive a fourth high-voltage signal, the nineteenth drain coupled to the second scanning signal output terminal, the nineteenth TFT utilized to turn on a nineteenth current channel between the nineteenth source and the nineteenth drain when the fourth stage transmission signal or the fifth clock signal received by the nineteenth gate is a low level signal, and utilized to turn off the nineteenth current channel when the fourth stage transmission signal or the fifth clock signal is a low level signal; a twentieth TFT comprising a twentieth gate, a twentieth source, and a twentieth drain, the twentieth gate coupled to the second latch signal input terminal, the twentieth gate utilized to receive the latch signal provided by the second latch signal input terminal, the twentieth source utilized to receive the fourth high-voltage signal, the twentieth drain coupled to the second scanning signal output terminal, the twentieth TFT utilized to turn on a twentieth current channel between the twentieth source and the twentieth drain when the latch signal received by the twentieth gate is a low level signal, and utilized to turn off the twentieth current channel when the latch signal is a high level signal; a twenty-first TFT comprising a the twenty-first gate, a twenty-first source, and a twenty-first drain, the twenty-first gate coupled to the third clock signal input terminal or the sixth clock signal input terminal, the twenty-first gate utilized to receive a third clock signal provided by the third clock signal input terminal or a sixth clock signal provided by the sixth clock signal input terminal, the twenty-first source utilized to receive the fourth high-voltage signal, the twenty-first drain coupled to the second scanning signal output terminal, the twenty-first TFT utilized to turn on a twenty-first current channel between the twenty-first source and the twenty-first drain when the third clock signal or the sixth clock signal received by the twenty-first gate is a low level signal, and utilized to turn off the twenty-first current channel when the third clock signal or the sixth clock signal is a high level signal; a twenty-second TFT comprising a the twenty-second gate, a twenty-second source, and a twenty-second drain, the twenty-second gate coupled to the fifth stage transmission signal input terminal or the fifth clock signal input terminal, the twenty-second gate utilized to receive a fourth stage transmission signal provided by the fifth stage transmission signal input terminal or the fifth clock signal provided by the fifth clock signal input terminal, the twenty-second drain coupled to the second scanning signal output terminal, the twenty-second TFT utilized to turn on a twenty-second current channel between the twenty-second source and the twenty-second drain when the fourth stage transmission signal or the fifth clock signal received by the twenty-second gate is a high level signal, and utilized to turn off the twenty-second current channel when the fourth stage transmission signal or the fifth clock signal is a low level signal; a twenty-third TFT comprising a the twenty-third gate, a twenty-third source, and a twenty-third drain, the twenty-third gate coupled to the second latch signal input terminal, the twenty-third gate utilized to receive the latch signal provided by the second latch signal input terminal, the twenty-third drain coupled to the twenty-second source, the twenty-third TFT utilized to turn on a twenty-third current channel between the twenty-third source and the twenty-third drain when the latch signal received by the twenty-third gate is a high level signal, and utilized to turn off the twenty-third current channel when the latch signal is a low level signal; and a twenty-fourth TFT comprising a the twenty-fourth gate, a twenty-fourth source, and a twenty-fourth drain, the twenty-fourth gate coupled to the third clock signal input terminal or the sixth clock signal input terminal, the twenty-fourth gate utilized to receive the third clock signal provided by the third clock signal input terminal or a sixth clock signal provided by the sixth clock signal input terminal, the twenty-fourth source utilized to receive the fourth low-voltage signal, the twenty-fourth drain coupled to the twenty-third source, the twenty-fourth TFT utilized to turn on a twenty-fourth current channel between the twenty-fourth source and the twenty-fourth drain when the third clock signal or the sixth clock signal received by the twenty-fourth gate is a high level signal, and utilized to turn off the twenty-fourth current channel when the third clock signal or the sixth clock signal is a low level signal.

In the above-mentioned driving circuit, the first inverted output unit comprises a first scanning signal input terminal and the inverted first scanning signal output terminal; the first inverted output unit comprising: a fifth inverter comprising a fifth inverted input terminal and a fifth inverted output terminal, the fifth inverted input terminal coupled to the first scanning signal input terminal, the fifth inverted output terminal coupled to the inverted first scanning signal output terminal.

In the above-mentioned driving circuit, the first inverted output unit is further utilized to stabilize the first scanning signal for generating the inverted first scanning signal, the first inverted output unit further comprising: a sixth inverter comprising a sixth inverted input terminal and a sixth inverted output terminal, the sixth inverted input terminal coupled to the fifth inverted output terminal; and a seventh inverter comprising a seventh inverted input terminal and a seventh inverted output terminal, the seventh inverted input terminal coupled to the sixth inverted output terminal, the seventh inverted output terminal coupled to the inverted first scanning signal output terminal.

In the above-mentioned driving circuit, the second inverted output unit comprises a second scanning signal input terminal and the inverted second scanning signal output terminal; the second inverted output unit comprising: an eighth inverter comprising an eighth inverted input terminal and an eighth inverted output terminal, the eighth inverted input terminal coupled to the second scanning signal input terminal, the eighth inverted output terminal coupled to the inverted second scanning signal output terminal.

In the above-mentioned driving circuit, the second inverted output unit is further utilized to stabilize the second scanning signal for generating the inverted second scanning signal, the second inverted output unit further comprising: a ninth inverter comprising a ninth inverted input terminal and a ninth inverted output terminal, the ninth inverted input terminal coupled to the eighth inverted output terminal; and a tenth inverter comprising a tenth inverted input terminal and a tenth inverted output terminal, the tenth inverted input terminal coupled to the ninth inverted output terminal, the tenth inverted output terminal coupled to the inverted second scanning signal output terminal.

In the above-mentioned driving circuit, the driving circuit further comprises: a clock signal inverting processing unit utilized to invert the second clock signal for generating the sixth clock signal.

In the above-mentioned driving circuit, the clock signal inverting processing unit comprises a thirteenth inverter, the thirteenth inverter utilized to receive the second clock signal and utilized to invert the second clock signal for generating the sixth clock signal.

In the above-mentioned driving circuit, the driving circuit further comprises: a resetting unit comprising a twenty-fifth TFT, the twenty-fifth TFT comprises a twenty-fifth gate, a twenty-fifth source and a twenty-fifth drain; the twenty-fifth source utilized to receive a fifth high-voltage signal, the twenty-fifth drain coupled to the stage transmission signal latch unit; the twenty-fifth gate utilized to receive a circuit resetting signal, and utilized to turn on or turn off a twenty-fifth current channel between the twenty-fifth source and the twenty-fifth drain according to the circuit resetting signal.

In comparison with the prior art, the present invention can simplify the configuration of the GOA circuit to meet the requirement of the display panel with an ultra-narrow bezel.

It is to be understood that both the foregoing general description and the following detailed description of the present invention are exemplary and explanatory and are intended to provide further explanation of the invention as claimed.

DETAILED DESCRIPTION OF THE INVENTION

The word "embodiment" is used herein to mean an example, instance, or illustration. In addition, articles "a" and "an" as used in this application and the appended claims should generally be construed to mean "one or more" unless specified otherwise or clear from the context to be directed to a singular form.

The driving circuit of the present invention applies to a display panel, such as a TFT-LCD (Thin Film Transistor Liquid Crystal Display) panel, an OLED (Organic Light Emitting Diode) display panel and so on. The driving circuit of the present invention is utilized to provide driving signals (scanning signals) for the display panel.

Figure 1:
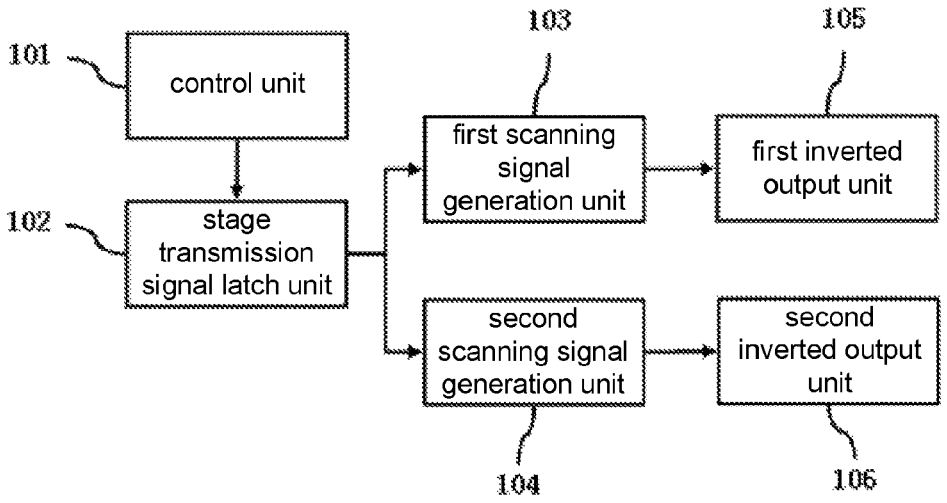
FIG. 1 is a block diagram illustrating a first embodiment of a driving circuit of the present invention.
Figure 2:
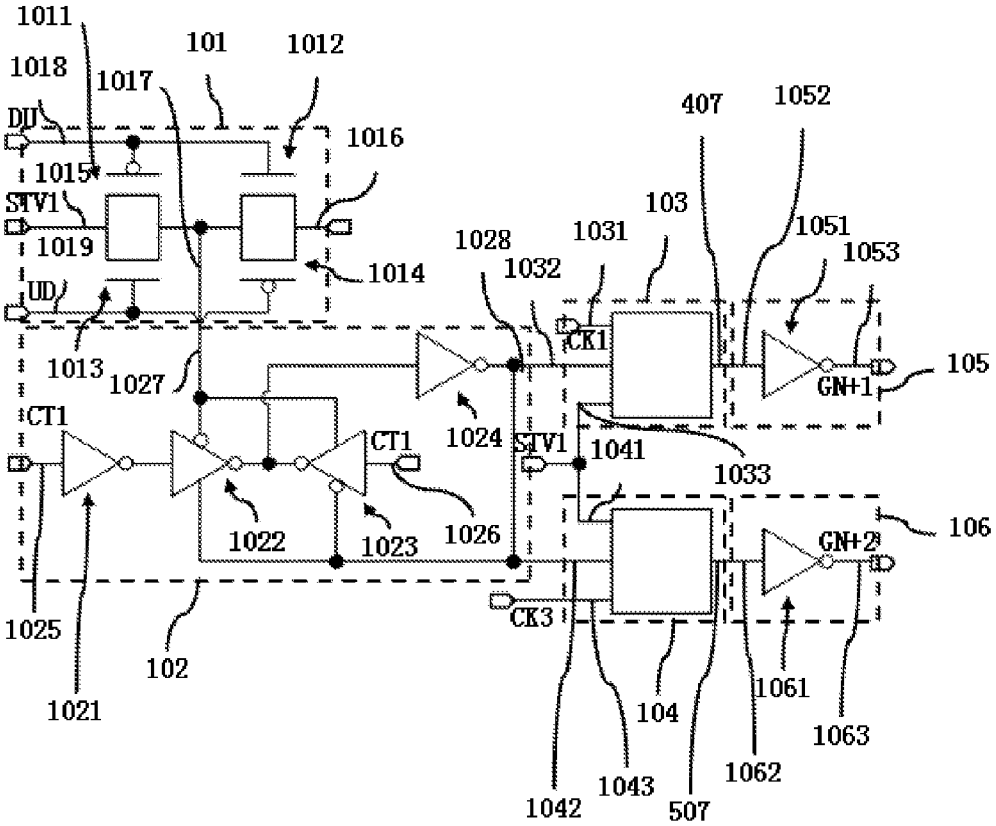
FIG. 2 is a circuit diagram illustrating a first embodiment of the driving circuit of FIG. 1.

Referring to FIG. 1 and FIG. 2, FIG. 1 is a block diagram illustrating a first embodiment of a driving circuit of the present invention; FIG. 2 is a circuit diagram illustrating a first embodiment of the driving circuit of FIG. 1.

The driving circuit of the embodiment includes at least two driving units. The at least two driving units are arranged in an array (e.g., one dimensional array), and the at least two driving units are coupled with each other (e.g., two adjacent driving units in the arrangement are coupled with each other, or two arbitrary driving units separated by at least one driving unit in the arrangement are coupled with each other). A first driving unit of the at least two driving units is utilized to receive at least one second sub signal of a second driving signal set which is generated by a second driving unit, and to generate a first driving signal set, in which the second driving unit is a driving unit except the first driving unit in the at least two the driving units.

In the embodiment, the driving unit includes a control unit 101, a stage transmission signal latch unit 102, a first scanning signal generation unit 103, a second scanning signal generation unit 104, a first inverted output unit 105, and a second inverted output unit 106.

The control unit 101 is utilized to control an output of a stage transmission signal according to forward and reverse scanning signals. The stage transmission signal latch unit 102 is utilized to receive the stage transmission signal and to latch the stage transmission signal for generating a latch signal. The first scanning signal generation unit 103 is utilized to generate a first scanning signal. The second scanning signal generation unit 104 is utilized to generate a second scanning signal. The first inverted output unit 105 is utilized to invert the first scanning signal and generate an inverted first scanning signal GN+1. The second inverted output unit 106 is utilized to invert the second scanning signal for generating an inverted second scanning signal GN+2.

In the embodiment, the control unit 101 includes a first stage transmission signal input terminal 1015, a second stage transmission signal input terminal 1016, a first switch control signal input terminal 1018, a second switch control signal input terminal 1019, and a first stage transmission signal output terminal 1017. The control unit 101 further includes a first TFT 1011, a second TFT 1012, a third TFT 1013, and a fourth TFT 1014.

The first TFT 1011 includes a gate a first source, and a first drain, the first gate coupled to the first switch control signal input terminal 1018, the first source coupled to the first stage transmission signal input terminal 1015, the first drain coupled to the first stage transmission signal output terminal 1017. The first TFT 1011 is utilized to control an output of a first stage transmission signal of the first stage transmission signal input terminal 1015 according to a first switch control signal DU provided by the first switch control signal input terminal 1018.

The second TFT 1012 includes a second gate, a second source, and a second drain, the second gate coupled to the first switch control signal input terminal 1018, the second source coupled to the second stage transmission signal input terminal 1016, the second drain coupled to the first stage transmission signal output terminal 1017. The second TFT 1012 is utilized to control an output of a second stage transmission signal of the second stage transmission signal input terminal 1016 according to the first switch control signal DU.

The third TFT 1013 includes a gate a third source, and a third drain, the third gate coupled to the second switch control signal input terminal 1019, the third source coupled to the first stage transmission signal input terminal 1015, the third drain coupled to the first stage transmission signal output terminal 1017. The third TFT 1013 utilized to control the output of the first stage transmission signal according to a second switch control signal UD provided by the second switch control signal input terminal 1019.

The fourth TFT 1014 includes a gate a fourth source, and a fourth drain, the fourth gate coupled to the second switch control signal input terminal 1019, the fourth source coupled to the second stage transmission signal input terminal 1016, the fourth drain coupled to the first stage transmission signal output terminal 1017. The fourth TFT 1014 is utilized to control the output of the second stage transmission signal according to the second switch control signal UD.

A second current channel of the second TFT 1021 is turned off when a first current channel of the first TFT 1011 is turned on, and the second current channel is turned on when the first current channel is turned off. The first current channel is a current channel between the first source and the first drain; the second current channel is a current channel between the second source and the second drain.

A fourth current channel of the fourth TFT 1014 is turned off when a third current channel of the third TFT 1013 is turned on, and the fourth current channel is turned on when the third current channel is turned off. The third current channel is a current channel between the third source and the third drain; the fourth current channel is a current channel between the fourth source and the fourth drain.

In the embodiment, the stage transmission signal latch unit 102 includes a first clock signal input terminal (1025, 1026), a third stage transmission signal input terminal 1027, and a latch signal output terminal 1028. The stage transmission signal latch unit 102 further includes a first inverter 1021, a second inverter 1022, a third inverter 1023, and a fourth inverter 1024.

The first inverter 1021 includes a first inverted input terminal and a first inverted output terminal, the first inverted input terminal coupled to the first clock signal input terminal (1025, 1026), the first inverted input terminal utilized to receive a first clock signal (CT1, CK).

The second inverter 1022 includes a second inverted input terminal and a second inverted output terminal, the second inverted input terminal coupled to the first inverted output terminal, the second inverter 1022 further coupled to the third stage transmission signal input terminal 1027 and the latch signal output terminal 1028.

The third inverter 1023 includes a third inverted input terminal and a third inverted output terminal, the third inverted input terminal coupled to the first clock signal input terminal (1025, 1026), the third inverter 1023 further coupled to the third stage transmission signal input terminal 1027 and the latch signal output terminal 1028. The third inverted input terminal is utilized to receive the first clock signal.

The fourth inverter 1024 includes a fourth inverted input terminal and a fourth inverted output terminal, the fourth inverted input terminal coupled to the third inverted output terminal and the second inverted output terminal, the fourth inverted output terminal coupled to the latch signal output terminal 1028.

A combination of the first inverter 1021, the second inverter 1022, the third inverter 1023, and the fourth inverter 1024 is utilized to shift and latch the stage transmission signal (STN signal).

Figure 3:
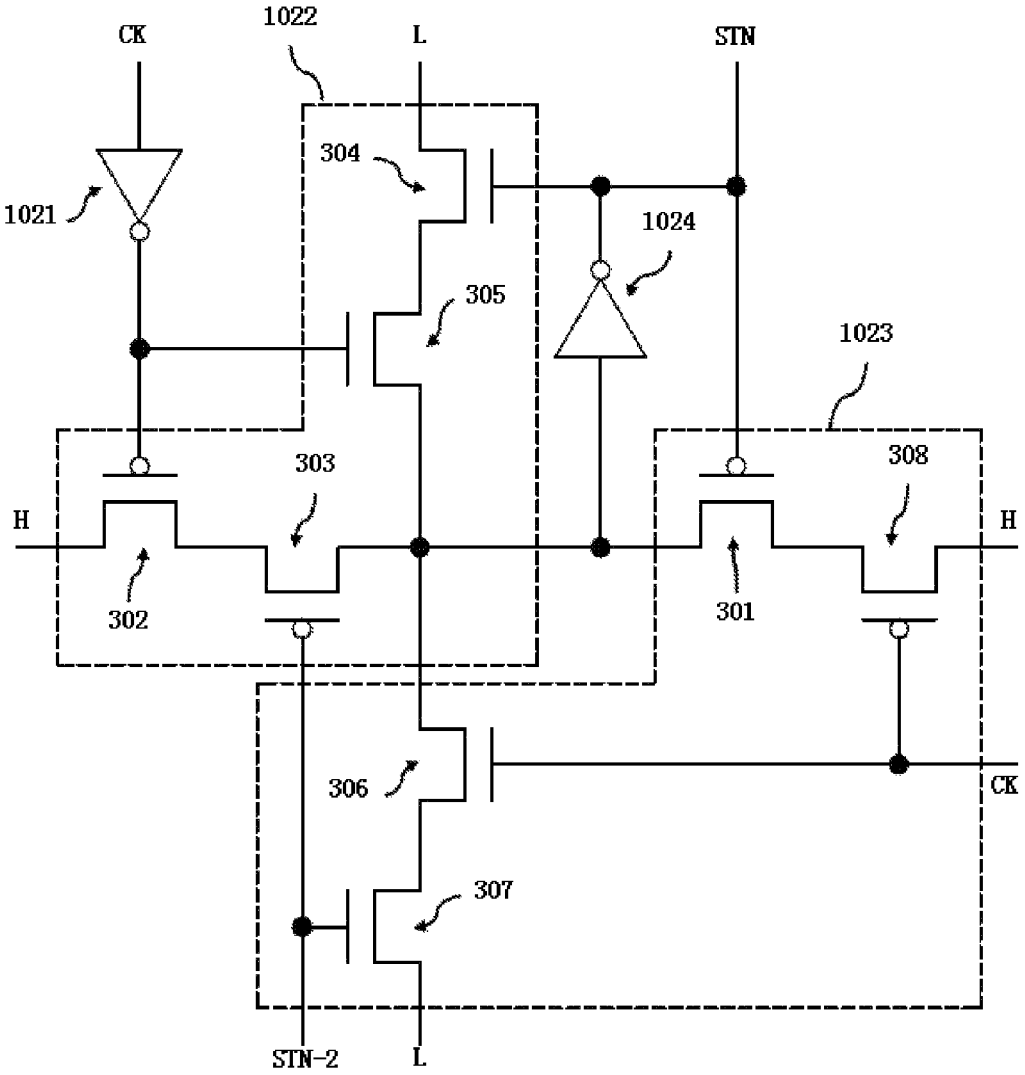
FIG. 3 is a circuit diagram illustrating stage transmission signal latch unit of FIG. 2.

Referring to FIG. 3, FIG. 3 is a circuit diagram illustrating stage transmission signal latch unit 102 of FIG. 2.

The second inverter 1022 includes a fifth TFT 302, a sixth TFT 303, a seventh TFT 304, and an eighth TFT 305, in which the second inverter 1022 is equivalent to the circuit consisting of the fifth TFT 302, the sixth TFT 303, the seventh TFT 304, and the eighth TFT 305. The third inverter 1023 includes a ninth TFT 306, a tenth TFT 307, an eleventh TFT 301, and a twelfth TFT 308, in which the third inverter 1023 is equivalent to the circuit consisting of the ninth TFT 306, the tenth TFT 307, the eleventh TFT 301, and the twelfth TFT 308.

The fifth TFT 302 includes a fifth gate, a fifth source, and a fifth drain, the fifth gate coupled to the first inverted output terminal, the fifth source utilized to receive a first high-voltage signal. The fifth TFT is utilized to turn on a fifth current channel between the fifth source and the fifth drain when the inverted first clock signal received by the fifth gate is a low level signal, and utilized to turn off the fifth current channel when the inverted first clock signal received by the fifth gate is a high level signal.

The sixth TFT 303 includes a sixth gate, a sixth source, and a sixth drain, the sixth gate utilized to receive the third stage transmission signal (STN-2), the sixth source coupled to the fifth drain, the sixth drain coupled to the fourth inverted input terminal. The sixth TFT 303 is utilized to turn on a sixth current channel between the sixth source and the sixth drain when the third stage transmission signal received by the sixth gate is a low level signal, and utilized to turn off the sixth current channel when the received third stage transmission signal is a high level signal.

the seventh TFT 304 includes a seventh gate, a seventh source, and a seventh drain, the seventh gate utilized to receive a fourth stage transmission signal (STN), the seventh source utilized to receive a first low-voltage signal. The seventh TFT 304 is utilized to turn on a seventh current channel between the seventh source and the seventh drain when the fourth stage transmission signal received by the seventh gate is a high level signal, and utilized to turn off the seventh current channel when the received fourth stage transmission signal is a low level signal.

The eighth TFT 305 includes an eighth gate, an eighth source, and an eighth drain, the eighth gate coupled to the first inverted output terminal, the eighth source coupled to the seventh drain, the eighth drain coupled to the fourth inverted input terminal. The eighth TFT 305 is utilized to turn on an eighth current channel between the eighth source and the eighth drain when the inverted first clock signal received the by the eighth gate is a high level signal, and utilized to turn off the eighth current channel when the inverted first clock signal received by the eighth gate is a low level signal.

The ninth TFT 306 includes a ninth gate, a ninth source, and a ninth drain, the ninth gate utilized to receive the first clock signal, the ninth drain coupled to the fourth inverted input terminal. The ninth TFT 306 is utilized to turn on a ninth current channel between the ninth source and the ninth drain when the first clock signal received by the ninth gate is a high level signal, and utilized to turn off the ninth current channel when the received first clock signal is a low level signal.

The tenth TFT 307 includes a tenth gate, a tenth source, and a tenth drain, the tenth gate coupled to the sixth gate, the tenth gate utilized to receive the third stage transmission signal, the tenth drain coupled to the ninth source, the tenth source utilized to receive a second low-voltage signal. The tenth TFT 307 is utilized to turn on a tenth current channel between the tenth source and the tenth drain when the third stage transmission signal received by the tenth gate is a high level signal, and utilized to turn off the tenth current channel when the received third stage transmission signal is a low level signal.

The eleventh TFT 301 includes an eleventh gate, an eleventh source, and an eleventh drain, the eleventh gate utilized to receive the fourth stage transmission signal, the eleventh drain further coupled to the fourth inverted input terminal. The eleventh TFT 301 is utilized to turn on an eleventh current channel between the eleventh source and the eleventh drain when the fourth stage transmission signal received by the eleventh gate is a low level signal, and utilized to turn off the eleventh current channel when the received fourth stage transmission signal is a high level signal.

The twelfth TFT 308 includes a twelfth gate, a twelfth source, and a twelfth drain, the twelfth gate utilized to receive the first clock signal, the twelfth source utilized to receive a second high-voltage signal, the twelfth drain coupled to the eleventh source. The twelfth TFT 308 is utilized to turn on a twelfth current channel between the twelfth source and the twelfth drain when the first clock signal received by the twelfth gate is a low level signal, and utilized to turn off the twelfth current channel when the received first clock signal is a high level signal.

The fourth inverted output terminal herein is further coupled to the seventh gate and the eleventh gate.

Figure 4:
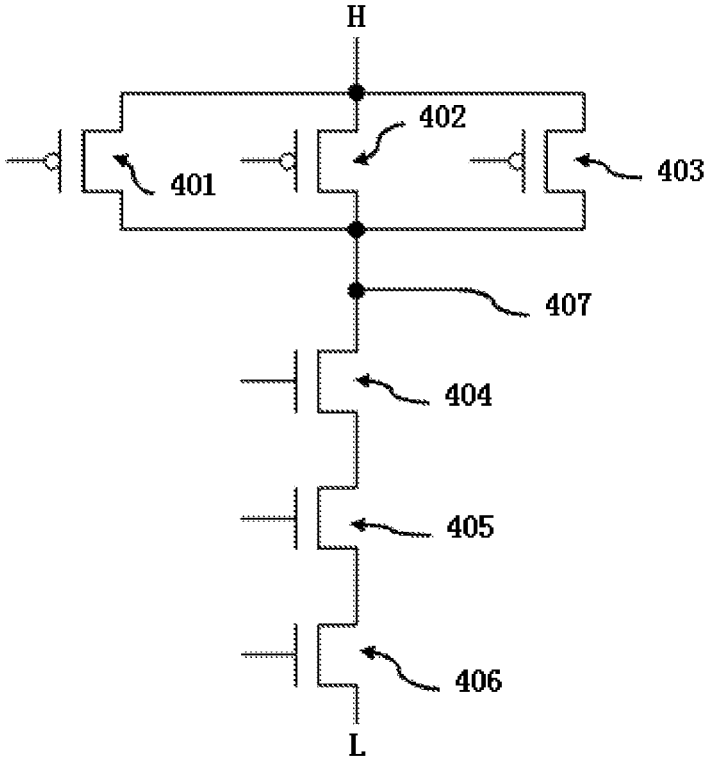
FIG. 4 is a circuit diagram illustrating a first scanning signal generation unit of FIG. 2.

Referring to FIG. 2 and FIG. 4, FIG. 4 is a circuit diagram illustrating a first scanning signal generation unit 103 of FIG. 2.

In the embodiment, the first scanning signal generation unit 103 includes a second clock signal input terminal 1031, a first latch signal input terminal 1032, a fourth stage transmission signal input terminal 1033/a fourth clock signal input terminal, and a first scanning signal output terminal 407, in which the first latch signal input terminal 1032 is coupled to the latch signal output terminal 1028. The first scanning signal generation unit 103 further includes a thirteenth TFT 401, a fourteenth TFT 402, a fifteenth TFT 403, and a sixteenth TFT 404, a seventeenth TFT 405, and an eighteenth TFT 406.

The thirteenth TFT 401 includes a thirteenth gate, a thirteenth source, and a thirteenth drain, the thirteenth gate coupled to the second clock signal input terminal 1031, the thirteenth gate utilized to receive a second clock signal provided by the second clock signal input terminal 1031, the thirteenth source utilized to receive a third high-voltage signal, the thirteenth drain coupled to the first scanning signal output terminal 407. The thirteenth TFT 401 is utilized to turn on a thirteenth current channel between the thirteenth source and the thirteenth drain when the second clock signal received by the thirteenth gate is a low level signal, and utilized to turn off the thirteenth current channel when the second clock signal is a high level signal.

The fourteenth TFT 402 includes a fourteenth gate, a fourteenth source, and a fourteenth drain, the fourteenth gate coupled to the first latch signal input terminal 1032, the fourteenth gate utilized to receive the latch signal provided by the first latch signal input terminal 1032, the fourteenth source utilized to receive the third high-voltage signal, the fourteenth drain coupled to the first scanning signal output terminal 407. The fourteenth TFT 402 is utilized to turn on a fourteenth current channel between the fourteenth source and the fourteenth drain when the latch signal received by the fourteenth gate is a low level signal, and utilized to turn off the fourteenth current channel when the latch signal is a high level signal.

The fifteenth TFT 403 includes a fifteenth gate a fifteenth source, and a fifteenth drain, the fifteenth gate coupled to the fourth stage transmission signal input terminal 1033 or the fourth clock signal input terminal, the fifteenth gate utilized to receive a fourth stage transmission signal provided by the fourth stage transmission signal input terminal 1033 or a fourth clock signal provided by the fourth clock signal input terminal, the fifteenth source utilized to receive the third high-voltage signal, the fifteenth drain coupled to the first scanning signal output terminal 407. The fifteenth TFT 403 is utilized to turn on a fifteenth current channel between the fifteenth source and the fifteenth drain when the fourth stage transmission signal or the fourth clock signal received by the fifteenth gate is a low level signal, and utilized to turn off the fifteenth current channel when the fourth stage transmission signal or the fourth clock signal is a low level signal.

The sixteenth TFT 404 includes a sixteenth gate a sixteenth source, and a sixteenth drain, the sixteenth gate coupled to the second clock signal input terminal 1031, the sixteenth gate utilized to receive the second clock signal provided by the second clock signal input terminal 1031, the sixteenth drain coupled to the first scanning signal output terminal 407. The sixteenth TFT 404 is utilized to turn on a sixteenth current channel between the sixteenth source and the sixteenth drain when the second clock signal received by the sixteenth gate is a high level signal, and utilized to turn off the sixteenth current channel when the second clock signal is a low level signal.

The seventeenth TFT includes a seventeenth gate, a seventeenth source, and a seventeenth drain, the seventeenth gate coupled to the first latch signal input terminal 1032, the seventeenth gate utilized to receive the latch signal provided by the first latch signal input terminal 1032, the seventeenth drain coupled to the sixteenth source. The seventeenth TFT 405 is utilized to turn on a seventeenth current channel between the seventeenth source and the seventeenth drain when the latch signal received by the seventeenth gate is a high level signal, and utilized to turn off the seventeenth current channel when the latch signal is a low level signal.

The eighteenth TFT 406 includes an eighteenth gate, an eighteenth source, and an eighteenth drain, the eighteenth gate coupled to the fourth stage transmission signal input terminal 1033 or the fourth clock signal input terminal, the eighteenth gate utilized to receive the fourth stage transmission signal provided by the fourth stage transmission signal input terminal 1033 or the fourth clock signal provided by the fourth clock signal input terminal, the eighteenth source utilized to receive the third low-voltage signal, the eighteenth drain coupled to the seventeenth source. The eighteenth TFT 406 is utilized to turn on a eighteenth current channel between the eighteenth source and the eighteenth drain when the fourth stage transmission signal or the fourth clock signal received by the eighteenth gate is a high level signal, and utilized to turn off the eighteenth current channel when the fourth stage transmission signal or the fourth clock signal is a low level signal.

Figure 5:
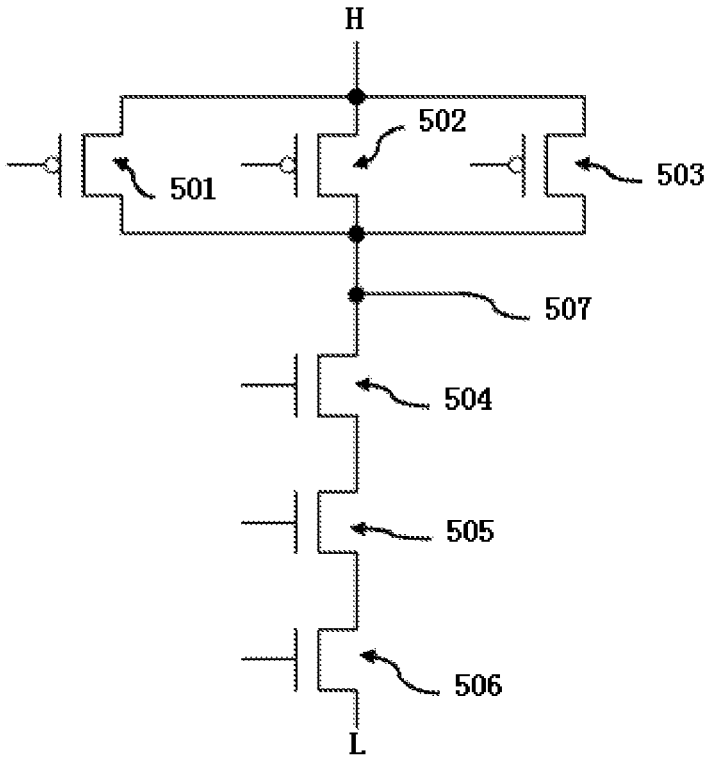
FIG. 5 is a circuit diagram illustrating a second scanning signal generation unit of FIG. 2.

Referring to FIG. 5, FIG. 5 is a circuit diagram illustrating a second scanning signal generation unit 104 of FIG. 2.

In the embodiment, the second scanning signal generation unit 104 includes a third clock signal input terminal 1043/a sixth clock signal input terminal, a second latch signal input terminal 1042, a fifth stage transmission signal input terminal 1041/a fifth clock signal input terminal, and a second scanning signal output terminal 507, in which the second latch signal input terminal 1042 is coupled to the latch signal output terminal 1028, the fifth stage transmission signal input terminal coupled to the fourth stage transmission signal input terminal 1033, the fifth clock signal input terminal 1043 coupled to the fourth clock signal input terminal. The second scanning signal generation unit 104 further includes a nineteenth TFT 501, a twentieth TFT 502, a twenty-first TFT 503, a twenty-second TFT 504, a twenty-third TFT 505, and a twenty-fourth TFT 506.

The nineteenth TFT includes a nineteenth gate, a nineteenth source, and a nineteenth drain, the nineteenth gate coupled to the fifth stage transmission signal input terminal 1041 or the fifth clock signal input terminal, the nineteenth gate utilized to receive a fourth stage transmission signal provided by the fifth stage transmission signal input terminal 1041 or a fifth clock signal provided by the fifth clock signal input terminal, the nineteenth source utilized to receive a fourth high-voltage signal, the nineteenth drain coupled to the second scanning signal output terminal 507, The nineteenth TFT 501 is utilized to turn on a nineteenth current channel between the nineteenth source and the nineteenth drain when the fourth stage transmission signal or the fifth clock signal received by the nineteenth gate is a low level signal, and utilized to turn off the nineteenth current channel when the fourth stage transmission signal or the fifth clock signal is a low level signal.

The twentieth TFT 502 includes a twentieth gate, a twentieth source, and a twentieth drain, the twentieth gate coupled to the second latch signal input terminal 1042, the twentieth gate utilized to receive the latch signal provided by the second latch signal input terminal 1042, the twentieth source utilized to receive the fourth high-voltage signal, the twentieth drain coupled to the second scanning signal output terminal 507. The twentieth TFT 502 is utilized to turn on a twentieth current channel between the twentieth source and the twentieth drain when the latch signal received by the twentieth gate is a low level signal, and utilized to turn off the twentieth current channel when the latch signal is a high level signal.

The twenty-first TFT comprising a the twenty-first gate, a twenty-first source, and a twenty-first drain, the twenty-first gate coupled to the third clock signal input terminal 1043 or the sixth clock signal input terminal, the twenty-first gate utilized to receive a third clock signal provided by the third clock signal input terminal 1043 or a sixth clock signal provided by the sixth clock signal input terminal, the twenty-first source utilized to receive the fourth high-voltage signal, the twenty-first drain coupled to the second scanning signal output terminal 507. The twenty-first TFT 503 is utilized to turn on a twenty-first current channel between the twenty-first source and the twenty-first drain when the third clock signal or the sixth clock signal received by the twenty-first gate is a low level signal, and utilized to turn off the twenty-first current channel when the third clock signal or the sixth clock signal is a high level signal.

The twenty-second TFT 504 includes a the twenty-second gate, a twenty-second source, and a twenty-second drain, the twenty-second gate coupled to the fifth stage transmission signal input terminal 1041 or the fifth clock signal input terminal, the twenty-second gate utilized to receive a fourth stage transmission signal provided by the fifth stage transmission signal input terminal 1041 or the fifth clock signal provided by the fifth clock signal input terminal, the twenty-second drain coupled to the second scanning signal output terminal 507, The twenty-second TFT 504 is utilized to turn on a twenty-second current channel between the twenty-second source and the twenty-second drain when the fourth stage transmission signal or the fifth clock signal received by the twenty-second gate is a high level signal, and utilized to turn off the twenty-second current channel when the fourth stage transmission signal or the fifth clock signal is a low level signal.

The twenty-third TFT 505 includes a the twenty-third gate, a twenty-third source, and a twenty-third drain, the twenty-third gate coupled to the second latch signal input terminal 1042, the twenty-third gate utilized to receive the latch signal provided by the second latch signal input terminal 1042, the twenty-third drain coupled to the twenty-second source, the twenty-third TFT 505 is utilized to turn on a twenty-third current channel between the twenty-third source and the twenty-third drain when the latch signal received by the twenty-third gate is a high level signal, and utilized to turn off the twenty-third current channel when the latch signal is a low level signal.

The twenty-fourth TFT includes a the twenty-fourth gate, a twenty-fourth source, and a twenty-fourth drain, the twenty-fourth gate coupled to the third clock signal input terminal 1043 or the sixth clock signal input terminal, the twenty-fourth gate utilized to receive the third clock signal provided by the third clock signal input terminal 1043 or a sixth clock signal provided by the sixth clock signal input terminal, the twenty-fourth source utilized to receive the fourth low-voltage signal, the twenty-fourth drain coupled to the twenty-third source. The twenty-fourth TFT 506 is utilized to turn on a twenty-fourth current channel between the twenty-fourth source and the twenty-fourth drain when the third clock signal or the sixth clock signal received by the twenty-fourth gate is a high level signal, and utilized to turn off the twenty-fourth current channel when the third clock signal or the sixth clock signal is a low level signal.

In the embodiment, the first inverted output unit 105 includes a first scanning signal input terminal 1052 and the inverted first scanning signal output terminal 1053. The first inverted output unit 105 includes a fifth inverter 1051.

The fifth inverter 1051 includes a fifth inverted input terminal and a fifth inverted output terminal. The fifth inverted input terminal is coupled to the first scanning signal input terminal 1052, and the fifth inverted output terminal is coupled to the inverted first scanning signal output terminal 1053.

The second inverted output unit 106 includes a second scanning signal input terminal 1062 and the inverted second scanning signal output terminal 1063. The second inverted output unit 106 includes an eighth inverter 1061.

The eighth inverter 1061 includes an eighth inverted input terminal and an eighth inverted output terminal. The eighth inverted input terminal is coupled to the second scanning signal input terminal 1062, and the eighth inverted output terminal is coupled to the inverted second scanning signal output terminal 1063.

Figure 6:
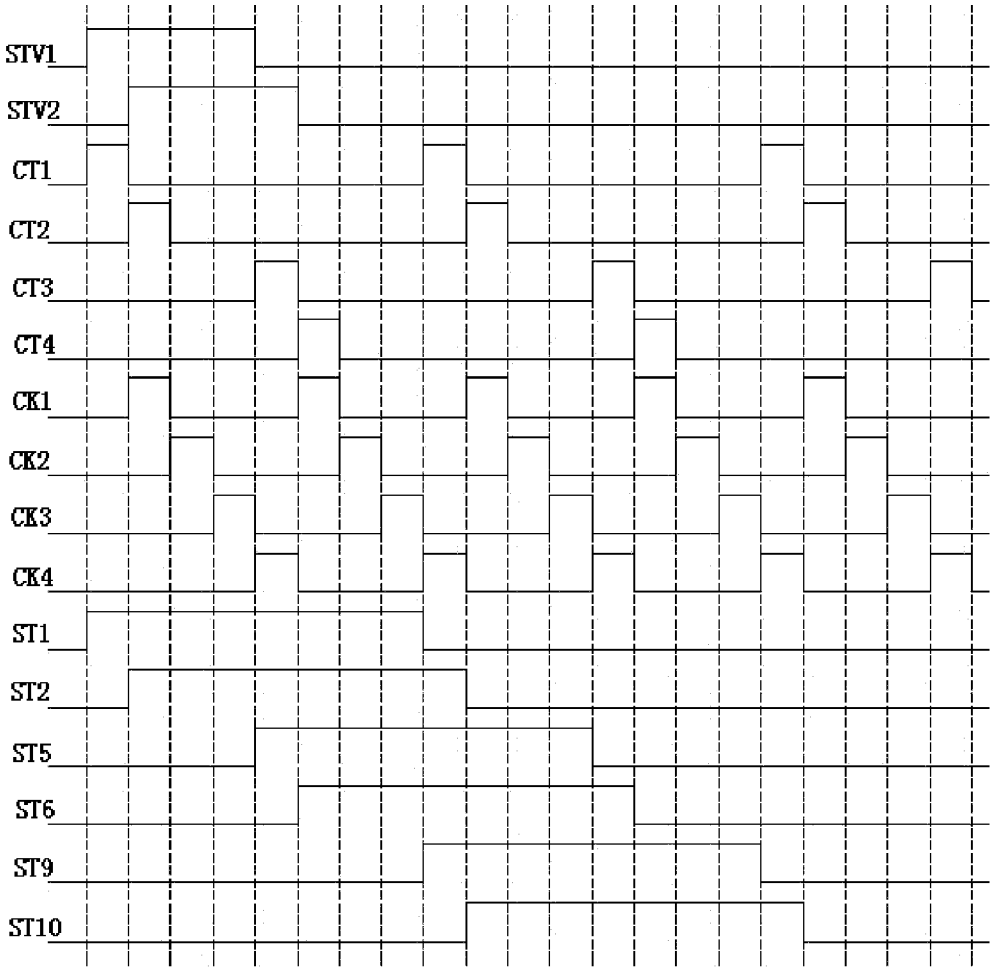
FIG. 6 is a schematic drawing illustrating a waveform of each signal in the first embodiment of the driving circuit of the present invention.

In summary, in the embodiment, the driving circuit achieves the output of the scanning signals, whose waveforms as shown in FIG. 6, by three stages: stage transmission, latch (output), and pull down. In the stage transmission stage, a STV1 high level signal is input and acted by a clock inverter with a CT1 high level signal, and then a ST1 high level signal is output. In the latch (output) stage, the ST1 high level signal and a CT1 low level signal are acted by the clock inverter, and then the ST1 high level signal keeps. Meanwhile, the ST1 signal, STV1 signal, and CK1 (CK3) signal are acted by a 3-input NAND gate, and the scanning signal with a high level is output. In the pull down stage, the STV1 low level signal and CT1 high level signal are acted by the clock inverter, a ST1 low signal is output for accomplishing the circuit pull down. The signals STV1, STV2, ST1, ST2, ST5, ST6, ST9, and ST10 herein are stage transmission signals. The signals CT1, CT2, CT3, CT4, CK1, CK2, CK3, and CK4 are clock signals. All of CT1, CT2, CT3, CT4 have a first high level duration, and CK1, CK2, CK3, CK4 have a second high level duration. The first high level duration is not the same to the second high level duration.

Through the above technical solution, the configuration of the driving circuit can be simplified, thereby being able to adapt to the requirement of the display panel with an ultra-narrow bezel.

Moreover, in the embodiment, it is advantageous to reduce the number of the thin film transistors (TFTs) of a NAND (Flash) unit in the conventional driving circuit by means of using the 3-input NAND gate to generate and output the scanning signals (including the first scanning signal and the second scanning signal).

Moreover, the technical solution of the embodiment can realize generating double-stage (double-line) scanning signals via single-stage latch signals. Therefore, it is advantageous to simplify the configuration of the driving circuit and ensure the stability of the driving circuit for a long time operation.

Figure 7:
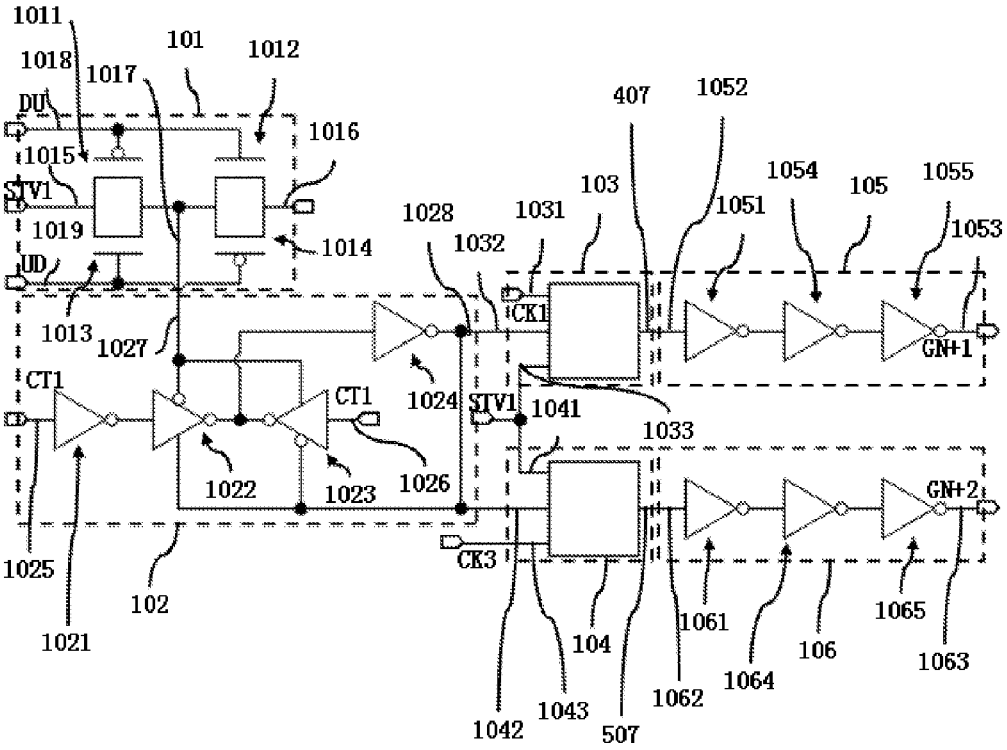
FIG. 7 is a circuit diagram illustrating a second embodiment of a driving circuit of the present invention.

Referring to FIG. 7, FIG. 7 is a circuit diagram illustrating a second embodiment of a driving circuit of the present invention. The difference between the embodiment and the first embodiment is that:

In the embodiment, the first inverted output unit 105 is further utilized to stabilize the first scanning signal for generating the inverted first scanning signal GN+1. The first inverted output unit 105 further includes a sixth inverter 1054 and a seventh inverter 1055.

The sixth inverter 1054 includes a sixth inverted input terminal and a sixth inverted output terminal, and the sixth inverted input terminal is coupled to the fifth inverted output terminal.

The seventh inverter 1055 includes a seventh inverted input terminal and a seventh inverted output terminal, the seventh inverted input terminal coupled to the sixth inverted output terminal, the seventh inverted output terminal coupled to the inverted first scanning signal output terminal 1053.

The second inverted output unit 106 is further utilized to stabilize the second scanning signal for generating the inverted second scanning signal GN+2, The second inverted output unit 106 further includes a ninth inverter 1064 and a tenth inverter 1065.

The ninth inverter 1064 includes a ninth inverted input terminal and a ninth inverted output terminal, and the ninth inverted input terminal is coupled to the eighth inverted output terminal.

The tenth inverter 1065 includes a tenth inverted input terminal and a tenth inverted output terminal, the tenth inverted input terminal coupled to the ninth inverted output terminal, the tenth inverted output terminal coupled to the inverted second scanning signal output terminal 1063.

Figure 8:
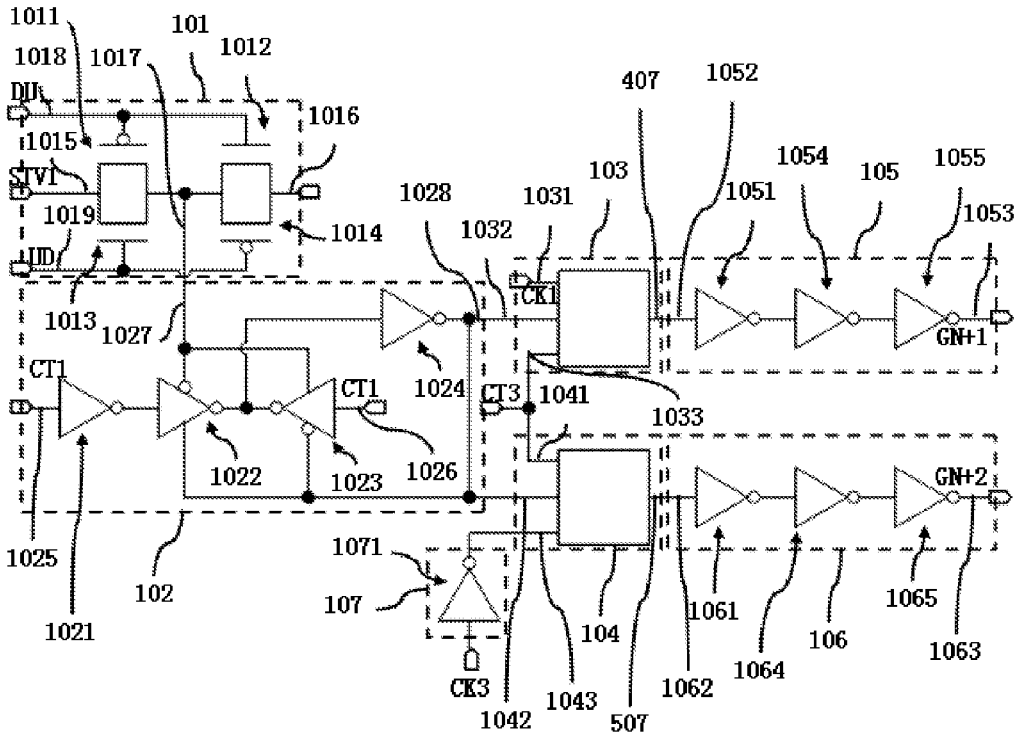
FIG. 8 is a schematic drawing illustrating a waveform of each signal in the second embodiment of the driving circuit of the present invention.

Referring to FIG. 8, FIG. 8 is a circuit diagram illustrating a third embodiment of a driving circuit of the present invention. The difference between the embodiment and the first or second embodiment is that:

In the embodiment, the fourth stage transmission signal input terminal 1033 of the first scanning signal generation unit 103 is replaced with a fourth clock signal input terminal (CT3).

The fifteenth gate is coupled to the fourth clock signal input terminal. The fifteenth gate utilized to receive a fourth clock signal provided by the fourth clock signal input terminal. The fifteenth TFT 403 is utilized to turn on a fifteenth current channel between the fifteenth source and the fifteenth drain when the fourth clock signal received by the fifteenth gate is a low level signal, and utilized to turn off the fifteenth current channel when the fourth clock signal is a high level signal.

The eighteenth gate is coupled to the fourth clock signal input terminal. The eighteenth gate utilized to receive the fourth clock signal provided by the fourth clock signal input terminal. The eighteenth TFT 406 is utilized to turn on an eighteenth current channel between the eighteenth source and the eighteenth drain when the fourth clock signal received by the eighteenth gate is a high level signal, and utilized to turn off the eighteenth current channel when the fourth clock signal is a low level signal.

The third clock signal input terminal 1043 of the second scanning signal generation unit 104 is replaced with a sixth clock signal input terminal, and the fifth stage transmission signal input terminal 1041 is replaced with a fifth clock signal input terminal (CT3), in which the fifth clock signal input terminal coupled to the fourth clock signal input terminal.

The nineteenth gate is coupled to the fifth clock signal input terminal, and the nineteenth gate is utilized to receive a fifth clock signal provided by the fifth clock signal input terminal. The nineteenth TFT 501 is utilized to turn on a nineteenth current channel between the nineteenth source and the nineteenth drain when the fifth clock signal received by the nineteenth gate is a low level signal, and utilized to turn off the nineteenth current channel when the fifth clock signal is a high level signal.

The twenty-first gate is coupled to the sixth clock signal input terminal, and the twenty-first gate is utilized to receive a sixth clock signal provided by the sixth clock signal input terminal, The twenty-first TFT 503 is utilized to turn on a twenty-first current channel between the twenty-first source and the twenty-first drain when the sixth clock signal received by the twenty-first gate is a low level signal, and utilized to turn off the twenty-first current channel when the sixth clock signal is a high level signal.

The twenty-second gate is coupled to the fifth clock signal input terminal, and the twenty-second gate is utilized to receive the fifth clock signal provided by the fifth clock signal input terminal. The twenty-second TFT 504 is utilized to turn on a twenty-second current channel between the twenty-second source and the twenty-second drain when the fifth clock signal received by the twenty-second gate is a high level signal, and utilized to turn off the twenty-second current channel when the fifth clock signal is a low level signal.

The twenty-fourth gate is coupled to the sixth clock signal input terminal, and the twenty-fourth gate is utilized to receive the sixth clock signal provided by the sixth clock signal input terminal, The twenty-fourth TFT 506 is utilized to turn on a twenty-fourth current channel between the twenty-fourth source and the twenty-fourth drain when the sixth clock signal received by the twenty-fourth gate is a high level signal, and utilized to turn off the twenty-fourth current channel when the sixth clock signal is a low level signal.

The driving circuit further includes a clock signal inverting processing unit 107. The clock signal inverting processing unit 107 includes a thirteenth inverter 1071. The thirteenth inverter 1071 is utilized to receive the second clock signal (CK3) and utilized to invert the second clock signal for generating the sixth clock signal.

Figure 9:
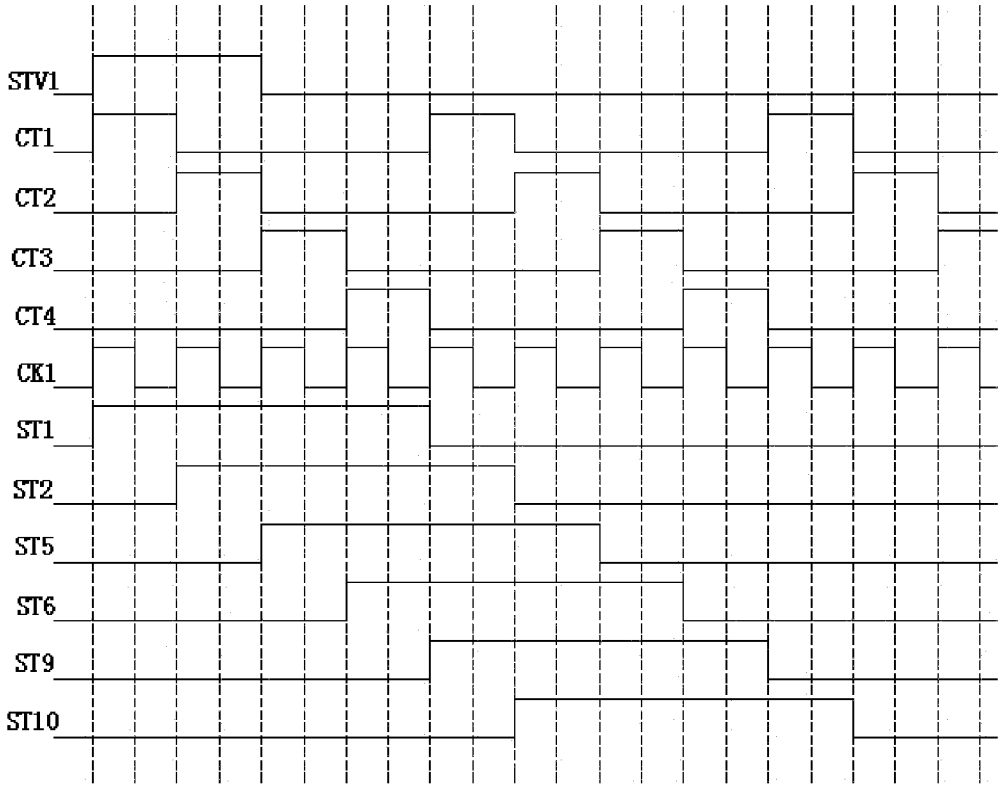
FIG. 9 is a circuit diagram illustrating a third embodiment of a driving circuit of the present invention.

In the embodiment, the waveforms of the related signals are shown in FIG. 9.

Figure 10:
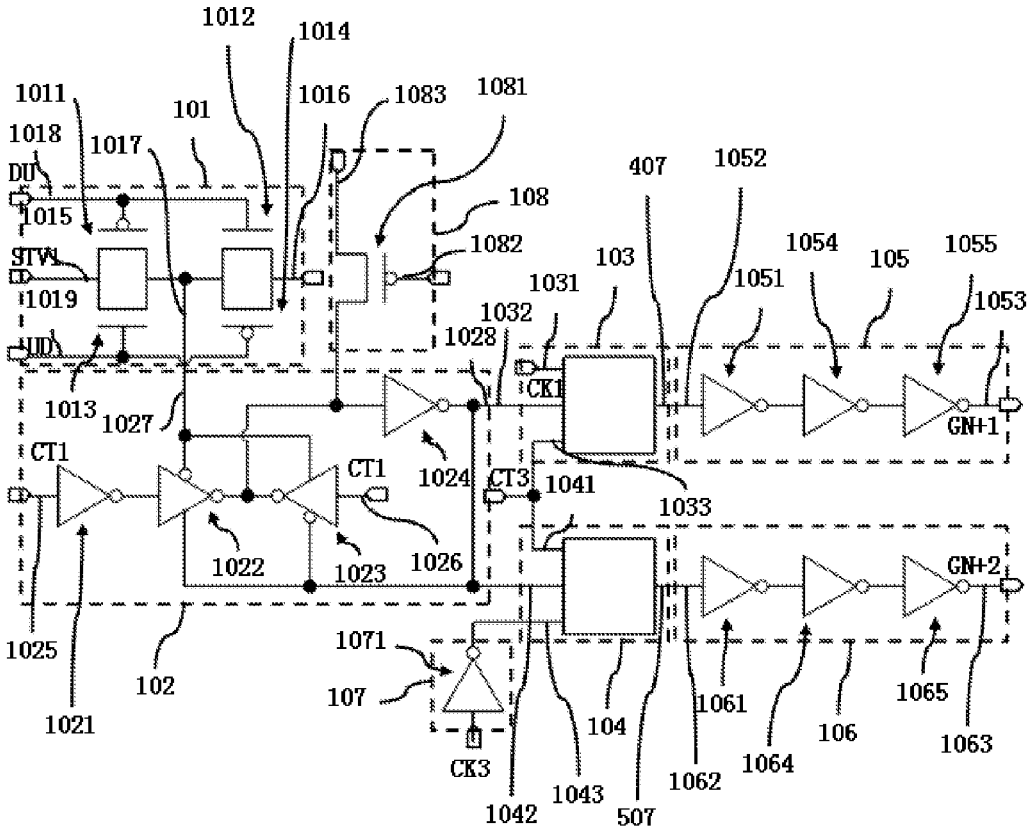
FIG. 10 is a circuit diagram illustrating a fourth embodiment of a driving circuit of the present invention.

Referring to FIG. 10, FIG. 10 is a circuit diagram illustrating a fourth embodiment of a driving circuit of the present invention. The difference between the embodiment and the first to the third embodiment is that:

The driving circuit further includes a resetting unit 108. The resetting unit 108 includes a twenty-fifth TFT 1081. The twenty-fifth TFT 1081 includes a twenty-fifth gate 1082, a twenty-fifth source 1083 and a twenty-fifth drain, the twenty-fifth source 1083 utilized to receive a fifth high-voltage signal, the twenty-fifth drain coupled to the stage transmission signal latch unit 102. Specifically, the twenty-fifth drain is coupled to the fourth inverted input terminal of the stage transmission signal latch unit 102. The twenty-fifth gate 1082 is utilized to receive a circuit resetting signal, and utilized to turn on or turn off a twenty-fifth current channel between the twenty-fifth source 1083 and the twenty-fifth drain according to the circuit resetting signal.

Although the disclosure has been shown and described with respect to one or more implementations, equivalent alterations and modifications will occur to others skilled in the art based upon a reading and understanding of this specification and the annexed drawings. The disclosure includes all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed configuration which performs the function in the herein illustrated exemplary implementations of the disclosure. In addition, while a particular feature of the disclosure may have been disclosed with respect to only one of several implementations, such feature may be combined with one or more other features of the other implementations as may be desired and advantageous for any given or particular application. Furthermore, to the extent that the terms "includes", "having", "has", "with", or variants thereof are used in either the detailed description or the claims, such terms are intended to be inclusive in a manner similar to the term "comprising."

While the preferred embodiments of the present invention have been illustrated and described in detail, various modifications and alterations can be made by persons skilled in this art. The embodiment of the present invention is therefore described in an illustrative but not restrictive sense. It is intended that the present invention should not be limited to the particular forms as illustrated, and that all modifications and alterations which maintain the spirit and realm of the present invention are within the scope as defined in the appended claims.

What is claimed is:

1. A driving circuit, comprising:

at least two driving units arranged in an array and coupled with each other, a first driving unit of the at least two driving units utilized to receive at least one second sub signal of a second driving signal set which is generated by a second driving unit, and to generate a first driving signal set, wherein the second driving unit is a driving unit except the first driving unit in the at least two the driving units;

wherein the driving unit comprises:

a control unit utilized to control an output of a stage transmission signal according to forward and reverse scanning signals;

a stage transmission signal latch unit utilized to receive the stage transmission signal and to latch the stage transmission signal for generating a latch signal;

a first scanning signal generation unit utilized to generate a first scanning signal;

a second scanning signal generation unit utilized to generate a second scanning signal;

a first inverted output unit utilized to invert the first scanning signal and generate an inverted first scanning signal; and a second inverted output unit utilized to invert the second scanning signal generate an inverted second scanning signal;

the control unit comprising a first stage transmission signal input terminal, a second stage transmission signal input terminal, a first switch control signal input terminal, a second switch control signal input terminal, and a first stage transmission signal output terminal;

the control unit further comprising:

a first TFT comprising a first gate, a first source, and a first drain, the first gate coupled to the first switch control signal input terminal, the first source coupled to the first stage transmission signal input terminal, the first drain coupled to the first stage transmission signal output terminal, the first TFT utilized to control an output of a first stage transmission signal of the first stage transmission signal input terminal according to a first switch control signal provided by the first switch control signal input terminal;

a second TFT comprising a second gate, a second source, and a second drain, the second gate coupled to the first switch control signal input terminal, the second source coupled to the second stage transmission signal input terminal, the second drain coupled to the first stage transmission signal output terminal, the second TFT utilized to control an output of a second stage transmission signal of the second stage transmission signal input terminal according to the first switch control signal;

a third TFT comprising a third gate, a third source, and a third drain, the third gate coupled to the second switch control signal input terminal, the third source coupled to the first stage transmission signal input terminal, the third drain coupled to the first stage transmission signal output terminal, the third TFT utilized to control the output of the first stage transmission signal according to a second switch control signal provided by the second switch control signal input terminal; and a fourth TFT comprising a fourth gate, a fourth source, and a fourth drain, the fourth gate coupled to the second switch control signal input terminal, the fourth source coupled to the second stage transmission signal input terminal, the fourth drain coupled to the first stage transmission signal output terminal, the fourth TFT utilized to control the output of the second stage transmission signal according to the second switch control signal;

the stage transmission signal latch unit comprising a first clock signal input terminal, a third stage transmission signal input terminal, and a latch signal output terminal;

the stage transmission signal latch unit further comprising:

a first inverter comprising a first inverted input terminal and a first inverted output terminal, the first inverted input terminal coupled to the first clock signal input terminal, the first inverted input terminal utilized to receive a first clock signal;

a second inverter comprising a second inverted input terminal and a second inverted output terminal, the second inverted input terminal coupled to the first inverted output terminal, the second inverter further coupled to the third stage transmission signal input terminal and the latch signal output terminal;

a third inverter comprising a third inverted input terminal and a third inverted output terminal, the third inverted input terminal coupled to the first clock signal input terminal, the third inverter further coupled to the third stage transmission signal input terminal and the latch signal output terminal, the third inverted input terminal utilized to receive the first clock signal; and a fourth inverter comprising a fourth inverted input terminal and a fourth inverted output terminal, the fourth inverted input terminal coupled to the third inverted output terminal and the second inverted output terminal, the fourth inverted output terminal coupled to the latch signal output terminal.

2. The driving circuit according to claim 1, wherein a second current channel of the second TFT is turn off when a first current channel of the first TFT is turned on, and the second current channel is turned on when the first current channel is turn off, the first current channel being a current channel between the first source and the first drain, the second current channel being a current channel between the second source and the second drain;

a fourth current channel of the fourth TFT is turn off when a third current channel of the third TFT is turned on, and the fourth current channel is turned on when the third current channel is turn off, the third current channel being a current channel between the third source and the third drain, the fourth current channel being a current channel between the fourth source and the fourth drain.

3. The driving circuit according to claim 1, wherein a combination of the first inverter, the second inverter, the third inverter, and the fourth inverter is utilized to shift and latch the stage transmission signal.

4. The driving circuit according to claim 1, wherein the second inverter comprises a fifth TFT, a sixth TFT, a seventh TFT and an eighth TFT;

the third inverter comprises a ninth TFT, a tenth TFT, an eleventh TFT and a twelfth TFT;

the fifth TFT comprises a fifth gate, a fifth source, and a fifth drain, the fifth gate coupled to the first inverted output terminal, the fifth source utilized to receive a first high-voltage signal, the fifth TFT utilized to turn on a fifth current channel between the fifth source and the fifth drain when the inverted first clock signal received by the fifth gate is a low level signal, and utilized to turn off the fifth current channel when the inverted first clock signal received by the fifth gate is a high level signal;

the sixth TFT comprises a sixth gate, a sixth source, and a sixth drain, the sixth gate utilized to receive the third stage transmission signal, the sixth source coupled to the fifth drain, the sixth drain coupled to the fourth inverted input terminal, the sixth TFT utilized to turn on a sixth current channel between the sixth source and the sixth drain when the third stage transmission signal received by the sixth gate is a low level signal, and utilized to turn off the sixth current channel when the received third stage transmission signal is a high level signal;

the seventh TFT comprises a seventh gate, a seventh source, and a seventh drain, the seventh gate utilized to receive a fourth stage transmission signal, the seventh source utilized to receive a first low-voltage signal, the seventh TFT utilized to turn on a seventh current channel between the seventh source and the seventh drain when the fourth stage transmission signal received by the seventh gate is a high level signal, and utilized to turn off the seventh current channel when the received fourth stage transmission signal is a low level signal;

the eighth TFT comprises an eighth gate, an eighth source, and an eighth drain, the eighth gate coupled to the first inverted output terminal, the eighth source coupled to the seventh drain, the eighth drain coupled to the fourth inverted input terminal, the eighth TFT utilized to turn on an eighth current channel between the eighth source and the eighth drain when the inverted first clock signal received the by the eighth gate is a high level signal, and utilized to turn off the eighth current channel when the inverted first clock signal received by the eighth gate is a low level signal;

the ninth TFT comprises a ninth gate, a ninth source, and a ninth drain, the ninth gate utilized to receive the first clock signal, the ninth drain coupled to the fourth inverted input terminal, the ninth TFT utilized to turn on a ninth current channel between the ninth source and the ninth drain when the first clock signal received by the ninth gate is a high level signal, and utilized to turn off the ninth current channel when the received first clock signal is a low level signal;

the tenth TFT comprises a tenth gate, a tenth source, and a tenth drain, the tenth gate coupled to the sixth gate, the tenth gate utilized to receive the third stage transmission signal, the tenth drain coupled to the ninth source, the tenth source utilized to receive a second low-voltage signal, the tenth TFT utilized to turn on a tenth current channel between the tenth source and the tenth drain when the third stage transmission signal received by the tenth gate is a high level signal, and utilized to turn off the tenth current channel when the received third stage transmission signal is a low level signal;

the eleventh TFT comprises an eleventh gate, an eleventh source, and an eleventh drain, the eleventh gate utilized to receive the fourth stage transmission signal, the eleventh drain further coupled to the fourth inverted input terminal, the eleventh TFT utilized to turn on an eleventh current channel between the eleventh source and the eleventh drain when the fourth stage transmission signal received by the eleventh gate is a low level signal, and utilized to turn off the eleventh current channel when the received fourth stage transmission signal is a high level signal; and the twelfth TFT comprises a twelfth gate, a twelfth source, and a twelfth drain, the twelfth gate utilized to receive the first clock signal, the twelfth source utilized to receive a second high-voltage signal, the twelfth drain coupled to the eleventh source, the twelfth TFT utilized to turn on a twelfth current channel between the twelfth source and the twelfth drain when the first clock signal received by the twelfth gate is a low level signal, and utilized to turn off the twelfth current channel when the received first clock signal is a high level signal;

wherein the fourth inverted output terminal is further coupled to the seventh gate and the eleventh gate.

5. The driving circuit according to claim 1, wherein the driving circuit further comprises:

a resetting unit comprising a twenty-fifth TFT, the twenty-fifth TFT comprises a twenty-fifth gate, a twenty-fifth source and a twenty-fifth drain;

the twenty-fifth source utilized to receive a fifth high-voltage signal, the twenty-fifth drain coupled to the stage transmission signal latch unit;

the twenty-fifth gate utilized to receive a circuit resetting signal, and utilized to turn on or turn off a twenty-fifth current channel between the twenty-fifth source and the twenty-fifth drain according to the circuit resetting signal.

6. A driving circuit, comprising:

at least two driving units arranged in an array and coupled with each other, a first driving unit of the at least two driving units utilized to receive at least one second sub signal of a second driving signal set which is generated by a second driving unit, and to generate a first driving signal set, wherein the second driving unit is a driving unit except the first driving unit in the at least two the driving units;

wherein the driving unit comprises:

a control unit utilized to control an output of a stage transmission signal according to forward and reverse scanning signals;

a stage transmission signal latch unit utilized to receive the stage transmission signal and to latch the stage transmission signal for generating a latch signal;

a first scanning signal generation unit utilized to generate a first scanning signal;

a second scanning signal generation unit utilized to generate a second scanning signal;

a first inverted output unit utilized to invert the first scanning signal and generate an inverted first scanning signal; and a second inverted output unit utilized to invert the second scanning signal for generating an inverted second scanning signal.

7. The driving circuit according to claim 6, wherein the control unit comprising a first stage transmission signal input terminal, a second stage transmission signal input terminal, a first switch control signal input terminal, a second switch control signal input terminal, and a first stage transmission signal output terminal;

the control unit further comprising:

a first TFT comprising a first gate, a first source, and a first drain, the first gate coupled to the first switch control signal input terminal, the first source coupled to the first stage transmission signal input terminal, the first drain coupled to the first stage transmission signal output terminal, the first TFT utilized to control an output of a first stage transmission signal of the first stage transmission signal input terminal according to a first switch control signal provided by the first switch control signal input terminal;

a second TFT comprising a second gate, a second source, and a second drain, the second gate coupled to the first switch control signal input terminal, the second source coupled to the second stage transmission signal input terminal, the second drain coupled to the first stage transmission signal output terminal, the second TFT utilized to control an output of a second stage transmission signal of the second stage transmission signal input terminal according to the first switch control signal;

a third TFT comprising a third gate, a third source, and a third drain, the third gate coupled to the second switch control signal input terminal, the third source coupled to the first stage transmission signal input terminal, the third drain coupled to the first stage transmission signal output terminal, the third TFT utilized to control the output of the first stage transmission signal according to a second switch control signal provided by the second switch control signal input terminal; and a fourth TFT comprising a fourth gate, a fourth source, and a fourth drain, the fourth gate coupled to the second switch control signal input terminal, the fourth source coupled to the second stage transmission signal input terminal, the fourth drain coupled to the first stage transmission signal output terminal, the fourth TFT utilized to control the output of the second stage transmission signal according to the second switch control signal.

8. The driving circuit according to claim 7, wherein a second current channel of the second TFT is turn off when a first current channel of the first TFT is turned on, and the second current channel is turned on when the first current channel is turn off, the first current channel being a current channel between the first source and the first drain, the second current channel being a current channel between the second source and the second drain;

a fourth current channel of the fourth TFT is turn off when a third current channel of the third TFT is turned on, and the fourth current channel is turned on when the third current channel is turn off, the third current channel being a current channel between the third source and the third drain, the fourth current channel being a current channel between the fourth source and the fourth drain.

9. The driving circuit according to claim 6, wherein the stage transmission signal latch unit comprising a first clock signal input terminal, a third stage transmission signal input terminal, and a latch signal output terminal;

the stage transmission signal latch unit further comprising:

a first inverter comprising a first inverted input terminal and a first inverted output terminal, the first inverted input terminal coupled to the first clock signal input terminal, the first inverted input terminal utilized to receive a first clock signal;

a second inverter comprising a second inverted input terminal and a second inverted output terminal, the second inverted input terminal coupled to the first inverted output terminal, the second inverter further coupled to the third stage transmission signal input terminal and the latch signal output terminal;

a third inverter comprising a third inverted input terminal and a third inverted output terminal, the third inverted input terminal coupled to the first clock signal input terminal, the third inverter further coupled to the third stage transmission signal input terminal and the latch signal output terminal, the third inverted input terminal utilized to receive the first clock signal; and a fourth inverter comprising a fourth inverted input terminal and a fourth inverted output terminal, the fourth inverted input terminal coupled to the third inverted output terminal and the second inverted output terminal, the fourth inverted output terminal coupled to the latch signal output terminal.

10. The driving circuit according to claim 9, wherein a combination of the first inverter, the second inverter, the third inverter, and the fourth inverter is utilized to shift and latch the stage transmission signal.

11. The driving circuit according to claim 9, wherein the second inverter comprises a fifth TFT, a sixth TFT, a seventh TFT and an eighth TFT;

the third inverter comprises a ninth TFT, a tenth TFT, an eleventh TFT and a twelfth TFT;

the fifth TFT comprises a fifth gate, a fifth source, and a fifth drain, the fifth gate coupled to the first inverted output terminal, the fifth source utilized to receive a first high-voltage signal, the fifth TFT utilized to turn on a fifth current channel between the fifth source and the fifth drain when the inverted first clock signal received by the fifth gate is a low level signal, and utilized to turn off the fifth current channel when the inverted first clock signal received by the fifth gate is a high level signal;

the sixth TFT comprises a sixth gate, a sixth source, and a sixth drain, the sixth gate utilized to receive the third stage transmission signal, the sixth source coupled to the fifth drain, the sixth drain coupled to the fourth inverted input terminal, the sixth TFT utilized to turn on a sixth current channel between the sixth source and the sixth drain when the third stage transmission signal received by the sixth gate is a low level signal, and utilized to turn off the sixth current channel when the received third stage transmission signal is a high level signal;

the seventh TFT comprises a seventh gate, a seventh source, and a seventh drain, the seventh gate utilized to receive a fourth stage transmission signal, the seventh source utilized to receive a first low-voltage signal, the seventh TFT utilized to turn on a seventh current channel between the seventh source and the seventh drain when the fourth stage transmission signal received by the seventh gate is a high level signal, and utilized to turn off the seventh current channel when the received fourth stage transmission signal is a low level signal;

the eighth TFT comprises an eighth gate, an eighth source, and an eighth drain, the eighth gate coupled to the first inverted output terminal, the eighth source coupled to the seventh drain, the eighth drain coupled to the fourth inverted input terminal, the eighth TFT utilized to turn on an eighth current channel between the eighth source and the eighth drain when the inverted first clock signal received the by the eighth gate is a high level signal, and utilized to turn off the eighth current channel when the inverted first clock signal received by the eighth gate is a low level signal;

the ninth TFT comprises a ninth gate, a ninth source, and a ninth drain, the ninth gate utilized to receive the first clock signal, the ninth drain coupled to the fourth inverted input terminal, the ninth TFT utilized to turn on a ninth current channel between the ninth source and the ninth drain when the first clock signal received by the ninth gate is a high level signal, and utilized to turn off the ninth current channel when the received first clock signal is a low level signal;

the tenth TFT comprises a tenth gate, a tenth source, and a tenth drain, the tenth gate coupled to the sixth gate, the tenth gate utilized to receive the third stage transmission signal, the tenth drain coupled to the ninth source, the tenth source utilized to receive a second low-voltage signal, the tenth TFT utilized to turn on a tenth current channel between the tenth source and the tenth drain when the third stage transmission signal received by the tenth gate is a high level signal, and utilized to turn off the tenth current channel when the received third stage transmission signal is a low level signal;

the eleventh TFT comprises an eleventh gate, an eleventh source, and an eleventh drain, the eleventh gate utilized to receive the fourth stage transmission signal, the eleventh drain further coupled to the fourth inverted input terminal, the eleventh TFT utilized to turn on an eleventh current channel between the eleventh source and the eleventh drain when the fourth stage transmission signal received by the eleventh gate is a low level signal, and utilized to turn off the eleventh current channel when the received fourth stage transmission signal is a high level signal; and the twelfth TFT comprises a twelfth gate, a twelfth source, and a twelfth drain, the twelfth gate utilized to receive the first clock signal, the twelfth source utilized to receive a second high-voltage signal, the twelfth drain coupled to the eleventh source, the twelfth TFT utilized to turn on a twelfth current channel between the twelfth source and the twelfth drain when the first clock signal received by the twelfth gate is a low level signal, and utilized to turn off the twelfth current channel when the received first clock signal is a high level signal;

wherein the fourth inverted output terminal is further coupled to the seventh gate and the eleventh gate.

12. The driving circuit according to claim 6, wherein the first scanning signal generation unit comprises a second clock signal input terminal, a first latch signal input terminal, a fourth stage transmission signal input terminal/a fourth clock signal input terminal, and a first scanning signal output terminal, wherein the first latch signal input terminal is coupled to the latch signal output terminal;

the first scanning signal generation unit further comprising:

a thirteenth TFT comprising a thirteenth gate, a thirteenth source, and a thirteenth drain, the thirteenth gate coupled to the second clock signal input terminal, the thirteenth gate utilized to receive a second clock signal provided by the second clock signal input terminal, the thirteenth source utilized to receive a third high-voltage signal, the thirteenth drain coupled to the first scanning signal output terminal, the thirteenth TFT utilized to turn on a thirteenth current channel between the thirteenth source and the thirteenth drain when the second clock signal received by the thirteenth gate is a low level signal, and utilized to turn off the thirteenth current channel when the second clock signal is a high level signal;

a fourteenth TFT comprising a fourteenth gate, a fourteenth source, and a fourteenth drain, the fourteenth gate coupled to the first latch signal input terminal, the fourteenth gate utilized to receive the latch signal provided by the first latch signal input terminal, the fourteenth source utilized to receive the third high-voltage signal, the fourteenth drain coupled to the first scanning signal output terminal, the fourteenth TFT utilized to turn on a fourteenth current channel between the fourteenth source and the fourteenth drain when the latch signal received by the fourteenth gate is a low level signal, and utilized to turn off the fourteenth current channel when the latch signal is a high level signal;

a fifteenth TFT comprising a fifteenth gate, a fifteenth source, and a fifteenth drain, the fifteenth gate coupled to the fourth stage transmission signal input terminal or the fourth clock signal input terminal, the fifteenth gate utilized to receive a fourth stage transmission signal provided by the fourth stage transmission signal input terminal or a fourth clock signal provided by the fourth clock signal input terminal, the fifteenth source utilized to receive the third high-voltage signal, the fifteenth drain coupled to the first scanning signal output terminal, the fifteenth TFT utilized to turn on a fifteenth current channel between the fifteenth source and the fifteenth drain when the fourth stage transmission signal or the fourth clock signal received by the fifteenth gate is a low level signal, and utilized to turn off the fifteenth current channel when the fourth stage transmission signal or the fourth clock signal is a low level signal;

a sixteenth TFT comprising a sixteenth gate, a sixteenth source, and a sixteenth drain, the sixteenth gate coupled to the second clock signal input terminal, the sixteenth gate utilized to receive the second clock signal provided by the second clock signal input terminal, the sixteenth drain coupled to the first scanning signal output terminal, the sixteenth TFT utilized to turn on a sixteenth current channel between the sixteenth source and the sixteenth drain when the second clock signal received by the sixteenth gate is a high level signal, and utilized to turn off the sixteenth current channel when the second clock signal is a low level signal;

a seventeenth TFT comprising a seventeenth gate, a seventeenth source, and a seventeenth drain, the seventeenth gate coupled to the first latch signal input terminal, the seventeenth gate utilized to receive the latch signal provided by the first latch signal input terminal, the seventeenth drain coupled to the sixteenth source, the seventeenth TFT utilized to turn on a seventeenth current channel between the seventeenth source and the seventeenth drain when the latch signal received by the seventeenth gate is a high level signal, and utilized to turn off the seventeenth current channel when the latch signal is a low level signal; and an eighteenth TFT comprising a eighteenth gate, a eighteenth source, and a eighteenth drain, the eighteenth gate coupled to the fourth stage transmission signal input terminal or the fourth clock signal input terminal, the eighteenth gate utilized to receive the fourth stage transmission signal provided by the fourth stage transmission signal input terminal or the fourth clock signal provided by the fourth clock signal input terminal, the eighteenth source utilized to receive the third low-voltage signal, the eighteenth drain coupled to the seventeenth source, the eighteenth TFT utilized to turn on a eighteenth current channel between the eighteenth source and the eighteenth drain when the fourth stage transmission signal or the fourth clock signal received by the eighteenth gate is a high level signal, and utilized to turn off the eighteenth current channel when the fourth stage transmission signal or the fourth clock signal is a low level signal;

the second scanning signal generation unit comprises a third clock signal input terminal/a sixth clock signal input terminal, a second latch signal input terminal, a fifth stage transmission signal input terminal/a fifth clock signal input terminal, and a second scanning signal output terminal, wherein the second latch signal input terminal is coupled to the latch signal output terminal, the fifth stage transmission signal input terminal coupled to the fourth stage transmission signal input terminal, the fifth clock signal input terminal coupled to the fourth clock signal input terminal;

the second scanning signal generation unit further comprising:

a nineteenth TFT comprising a nineteenth gate, a nineteenth source, and a nineteenth drain, the nineteenth gate coupled to the fifth stage transmission signal input terminal or the fifth clock signal input terminal, the nineteenth gate utilized to receive a fourth stage transmission signal provided by the fifth stage transmission signal input terminal or a fifth clock signal provided by the fifth clock signal input terminal, the nineteenth source utilized to receive a fourth high-voltage signal, the nineteenth drain coupled to the second scanning signal output terminal, the nineteenth TFT utilized to turn on a nineteenth current channel between the nineteenth source and the nineteenth drain when the fourth stage transmission signal or the fifth clock signal received by the nineteenth gate is a low level signal, and utilized to turn off the nineteenth current channel when the fourth stage transmission signal or the fifth clock signal is a low level signal;

a twentieth TFT comprising a twentieth gate, a twentieth source, and a twentieth drain, the twentieth gate coupled to the second latch signal input terminal, the twentieth gate utilized to receive the latch signal provided by the second latch signal input terminal, the twentieth source utilized to receive the fourth high-voltage signal, the twentieth drain coupled to the second scanning signal output terminal, the twentieth TFT utilized to turn on a twentieth current channel between the twentieth source and the twentieth drain when the latch signal received by the twentieth gate is a low level signal, and utilized to turn off the twentieth current channel when the latch signal is a high level signal;

a twenty-first TFT comprising a the twenty-first gate, a twenty-first source, and a twenty-first drain, the twenty-first gate coupled to the third clock signal input terminal or the sixth clock signal input terminal, the twenty-first gate utilized to receive a third clock signal provided by the third clock signal input terminal or a sixth clock signal provided by the sixth clock signal input terminal, the twenty-first source utilized to receive the fourth high-voltage signal, the twenty-first drain coupled to the second scanning signal output terminal, the twenty-first TFT utilized to turn on a twenty-first current channel between the twenty-first source and the twenty-first drain when the third clock signal or the sixth clock signal received by the twenty-first gate is a low level signal, and utilized to turn off the twenty-first current channel when the third clock signal or the sixth clock signal is a high level signal;

a twenty-second TFT comprising a the twenty-second gate, a twenty-second source, and a twenty-second drain, the twenty-second gate coupled to the fifth stage transmission signal input terminal or the fifth clock signal input terminal, the twenty-second gate utilized to receive a fourth stage transmission signal provided by the fifth stage transmission signal input terminal or the fifth clock signal provided by the fifth clock signal input terminal, the twenty-second drain coupled to the second scanning signal output terminal, the twenty-second TFT utilized to turn on a twenty-second current channel between the twenty-second source and the twenty-second drain when the fourth stage transmission signal or the fifth clock signal received by the twenty-second gate is a high level signal, and utilized to turn off the twenty-second current channel when the fourth stage transmission signal or the fifth clock signal is a low level signal;

a twenty-third TFT comprising a the twenty-third gate, a twenty-third source, and a twenty-third drain, the twenty-third gate coupled to the second latch signal input terminal, the twenty-third gate utilized to receive the latch signal provided by the second latch signal input terminal, the twenty-third drain coupled to the twenty-second source, the twenty-third TFT utilized to turn on a twenty-third current channel between the twenty-third source and the twenty-third drain when the latch signal received by the twenty-third gate is a high level signal, and utilized to turn off the twenty-third current channel when the latch signal is a low level signal; and a twenty-fourth TFT comprising a the twenty-fourth gate, a twenty-fourth source, and a twenty-fourth drain, the twenty-fourth gate coupled to the third clock signal input terminal or the sixth clock signal input terminal, the twenty-fourth gate utilized to receive the third clock signal provided by the third clock signal input terminal or a sixth clock signal provided by the sixth clock signal input terminal, the twenty-fourth source utilized to receive the fourth low-voltage signal, the twenty-fourth drain coupled to the twenty-third source, the twenty-fourth TFT utilized to turn on a twenty-fourth current channel between the twenty-fourth source and the twenty-fourth drain when the third clock signal or the sixth clock signal received by the twenty-fourth gate is a high level signal, and utilized to turn off the twenty-fourth current channel when the third clock signal or the sixth clock signal is a low level signal.

13. The driving circuit according to claim 12, wherein the first inverted output unit comprises a first scanning signal input terminal and the inverted first scanning signal output terminal;

the first inverted output unit comprising:

a fifth inverter comprising a fifth inverted input terminal and a fifth inverted output terminal, the fifth inverted input terminal coupled to the first scanning signal input terminal, the fifth inverted output terminal coupled to the inverted first scanning signal output terminal.

14. The driving circuit according to claim 13, wherein the first inverted output unit is further utilized to stabilize the first scanning signal for generating the inverted first scanning signal, the first inverted output unit further comprising:

a sixth inverter comprising a sixth inverted input terminal and a sixth inverted output terminal, the sixth inverted input terminal coupled to the fifth inverted output terminal; and a seventh inverter comprising a seventh inverted input terminal and a seventh inverted output terminal, the seventh inverted input terminal coupled to the sixth inverted output terminal, the seventh inverted output terminal coupled to the inverted first scanning signal output terminal.

15. The driving circuit according to claim 12, wherein the second inverted output unit comprises a second scanning signal input terminal and the inverted second scanning signal output terminal;

the second inverted output unit comprising:

an eighth inverter comprising an eighth inverted input terminal and an eighth inverted output terminal, the eighth inverted input terminal coupled to the second scanning signal input terminal, the eighth inverted output terminal coupled to the inverted second scanning signal output terminal.

16. The driving circuit according to claim 15, wherein the second inverted output unit is further utilized to stabilize the second scanning signal for generating the inverted second scanning signal, the second inverted output unit further comprising:

a ninth inverter comprising a ninth inverted input terminal and a ninth inverted output terminal, the ninth inverted input terminal coupled to the eighth inverted output terminal; and a tenth inverter comprising a tenth inverted input terminal and a tenth inverted output terminal, the tenth inverted input terminal coupled to the ninth inverted output terminal, the tenth inverted output terminal coupled to the inverted second scanning signal output terminal.

17. The driving circuit according to claim 12, wherein the driving circuit further comprises:

a clock signal inverting processing unit utilized to invert the second clock signal for generating the sixth clock signal.

18. The driving circuit according to claim 17, wherein the clock signal inverting processing unit comprises a thirteenth inverter, the thirteenth inverter utilized to receive the second clock signal and utilized to invert the second clock signal for generating the sixth clock signal.

19. The driving circuit according to claim 6, wherein the driving circuit further comprises:

a resetting unit comprising a twenty-fifth TFT, the twenty-fifth TFT comprises a twenty-fifth gate, a twenty-fifth source and a twenty-fifth drain;

the twenty-fifth source utilized to receive a fifth high-voltage signal, the twenty-fifth drain coupled to the stage transmission signal latch unit;

the twenty-fifth gate utilized to receive a circuit resetting signal, and utilized to turn on or turn off a twenty-fifth current channel between the twenty-fifth source and the twenty-fifth drain according to the circuit resetting signal.

* * * * *